US010841980B2

(12) United States Patent
Sajic

(10) Patent No.: US 10,841,980 B2
(45) Date of Patent: Nov. 17, 2020

(54) LAMINAR HEATING ELEMENTS WITH CUSTOMIZED OR NON-UNIFORM RESISTANCE AND/OR IRREGULAR SHAPES AND PROCESSES FOR MANUFACTURE

(71) Applicant: LaminaHeat Holding Ltd., Leixlip (IE)

(72) Inventor: Peter Sajic, Broadstone (GB)

(73) Assignee: Laminaheat Holding Ltd., Kildare (IE)

( * ) Notice: Subject to any disclaimer, the term of this patent is extended or adjusted under 35 U.S.C. 154(b) by 188 days.

(21) Appl. No.: 15/928,952

(22) Filed: Mar. 22, 2018

(65) Prior Publication Data

US 2018/0288830 A1 Oct. 4, 2018

Related U.S. Application Data

(63) Continuation-in-part of application No. PCT/IB2016/001584, filed on Oct. 14, 2016.
(Continued)

(51) Int. Cl.
*H05B 3/00* (2006.01)
*H05B 3/34* (2006.01)
*H05B 3/14* (2006.01)

(52) U.S. Cl.
CPC ..... *H05B 3/0014* (2013.01); *H05B 3/145* (2013.01); *H05B 3/34* (2013.01);
(Continued)

(58) Field of Classification Search
CPC ..... H05B 3/0014; H05B 3/145; H05B 2203/011; H05B 2203/005
(Continued)

(56) References Cited

U.S. PATENT DOCUMENTS 2,557,983 A * 6/1951 Linder ..... C03C 17/3411 219/543
2,971,073 A 2/1961 Eisler
(Continued)

FOREIGN PATENT DOCUMENTS

CN 104159341 B 12/2015
DE 1615494 A1 2/1971
(Continued)

OTHER PUBLICATIONS

Extended European Search Report for European Application No. 19 159 558.6, dated Aug. 6, 2019, 9 pages.
(Continued)

*Primary Examiner* — Thien S Tran
(74) *Attorney, Agent, or Firm* — RatnerPrestia

(57) ABSTRACT

Laminar heaters having a laminar heating element with a pair of electrically conductive busbars connected to opposite ends of the heating element and a plurality of areas. The heater has a first electrical resistance in a first area and a second electrical resistance in a second area. At least one of the first area or the second area comprises a plurality of perforations, and the difference between the first electrical resistance and the second electrical resistance arises from a difference in a perforation characteristic of the first portion relative to the second portion. A plurality of heaters or heating elements may be connected together in a system for heating a surface.

35 Claims, 11 Drawing Sheets

Related U.S. Application Data

(60) Provisional application No. 62/243,240, filed on Oct. 19, 2015, provisional application No. 62/243,271, filed on Oct. 19, 2015.

(52) U.S. Cl.
CPC .. *H05B 2203/005* (2013.01); *H05B 2203/011* (2013.01); *H05B 2203/037* (2013.01)

(58) Field of Classification Search
USPC ..... 219/211, 213, 528, 543, 545, 549
See application file for complete search history.

(56) References Cited

U.S. PATENT DOCUMENTS 3,266,005 A 8/1966 Balde et al.
3,774,299 A 11/1973 Salo et al.
4,007,083 A 2/1977 Ring et al.
4,049,491 A 9/1977 Brandon et al.
4,200,488 A 4/1980 Brandon et al.
4,485,297 A * 11/1984 Grise ..... H05B 3/56 219/528
4,534,886 A 8/1985 Kraus et al.
4,719,335 A 1/1988 Batliwalla et al.
4,725,717 A 2/1988 Harrison
4,728,395 A 3/1988 Boyd
4,737,618 A 4/1988 Barbier et al.
4,931,627 A * 6/1990 Watts ..... H05B 3/146 219/203
4,931,827 A 6/1990 Watts
4,960,979 A 10/1990 Nishimura
5,019,797 A 5/1991 Marstiller et al.
5,403,993 A * 4/1995 Cordia ..... B29C 65/18 219/549
5,582,757 A 12/1996 Kio et al.
5,900,295 A 5/1999 Kawada
5,925,275 A 7/1999 Lawson et al.
5,932,124 A 8/1999 Miller et al.
5,942,140 A 8/1999 Miller et al.
5,954,977 A 9/1999 Miler et al.
5,981,911 A 11/1999 Miller et al.
6,015,965 A 1/2000 Miller et al.
6,037,572 A 3/2000 Coates et al.
6,087,630 A 7/2000 Miller et al.
6,108,581 A 8/2000 Jung
6,124,571 A 9/2000 Miller et al.
6,145,787 A 11/2000 Rolls
6,184,496 B1 2/2001 Pearce
6,294,758 B1 9/2001 Masao et al.
6,483,087 B2 11/2002 Gardner et al.
6,593,555 B2 7/2003 Hayashi
6,710,313 B1 3/2004 Asami et al.
6,727,471 B2 4/2004 Evans et al.
6,737,611 B2 5/2004 Ek et al.
6,741,805 B2 5/2004 Wu
6,870,139 B2 3/2005 Petrenko
6,949,727 B2 9/2005 Parks
7,034,257 B2 4/2006 Petrenko
7,067,776 B2 7/2006 Michelmann
7,105,782 B2 9/2006 Yue
7,173,223 B2 2/2007 Kuo et al.
7,211,772 B2 5/2007 Carpino, II et al.
7,247,822 B2 7/2007 Johnston
7,268,325 B1 9/2007 Chuang
7,372,006 B2 5/2008 Aisenbrey
7,439,475 B2 10/2008 Ohta
7,570,760 B1 8/2009 Olson et al.
7,629,558 B2 12/2009 Petrenko
7,638,735 B2 12/2009 Petrenko
7,678,614 B2 3/2010 Huang et al.
7,703,300 B2 4/2010 Petrenko
7,781,706 B2 8/2010 Park
7,820,945 B2 10/2010 Seo
7,827,675 B2 11/2010 Pan et al.
7,838,804 B2 11/2010 Krobok
7,884,307 B2 2/2011 Li et al.
8,076,613 B2 12/2011 Raidt et al.
8,197,621 B2 6/2012 Jung
8,308,889 B2 11/2012 Glancy et al.
8,334,226 B2 12/2012 Nhan et al.
8,357,881 B2 1/2013 Feng et al.
8,405,002 B2 3/2013 Petrenko
8,519,305 B2 8/2013 Nakajima et al.
8,544,942 B2 10/2013 Lazanja et al.
8,674,265 B2 3/2014 Bode
8,702,164 B2 4/2014 Lazanja et al.
8,723,043 B2 5/2014 Weiss et al.
8,752,279 B2 6/2014 Brittingham et al.
8,866,052 B2 10/2014 Nhan et al.
8,921,739 B2 12/2014 Petrenko
8,931,751 B2 1/2015 Funke et al.
9,020,333 B2 4/2015 Bigex et al.
9,046,207 B2 6/2015 Bigex et al.
9,161,392 B2 10/2015 Anbe
9,185,748 B2 11/2015 Zimmerer et al.
9,241,373 B2 1/2016 Schaeffer et al.
9,269,560 B2 2/2016 Klumpp et al.
9,271,334 B2 2/2016 Fu
9,290,890 B2 3/2016 Naylor
9,945,080 B2 4/2018 Caterina et al.
10,442,273 B2 10/2019 Wittkowski et al.
2002/0153368 A1 10/2002 Gardner et al.
2003/0155347 A1 8/2003 Oh et al.
2004/0035853 A1 2/2004 Pais
2004/0055699 A1 3/2004 Smith et al.
2004/0056020 A1 3/2004 Helmreich et al.
2005/0167412 A1 8/2005 Anson et al.
2005/0184053 A1 8/2005 Wilkenson et al.
2005/0205551 A1 9/2005 Aisenbrey
2006/0043240 A1 3/2006 Hindel et al.
2006/0201933 A1 9/2006 Carpino et al.
2006/0278631 A1 12/2006 Lee et al.
2006/0289468 A1 12/2006 Seibert et al.
2007/0056946 A1 3/2007 Chen
2008/0156786 A1 7/2008 Choi
2008/0166563 A1 7/2008 Brittingham et al.
2008/0179448 A1* 7/2008 Layland ..... B64D 15/12 244/1 N
2008/0196429 A1 8/2008 Petrenko et al.
2008/0210679 A1 9/2008 Raidt et al.
2008/0223842 A1 9/2008 Petrenko et al.
2008/0272106 A1 11/2008 Naylor
2009/0041996 A1 2/2009 Boissy
2009/0127250 A1 5/2009 Chang
2009/0152257 A1 6/2009 Cheng
2009/0169826 A1 7/2009 Kuerschner
2009/0184106 A1 7/2009 Wu
2009/0218854 A1 9/2009 Pfahler et al.
2009/0235681 A1 9/2009 Petrenko et al.
2009/0289046 A1 11/2009 Richmond
2009/0294435 A1 12/2009 Nhan et al.
2010/0038356 A1 2/2010 Fukuda et al.
2010/0038357 A1 2/2010 Fukuda et al.
2010/0059503 A1 3/2010 Petrenko
2010/0084389 A1 4/2010 Petrenko
2010/0176118 A1 7/2010 Lee et al.
2010/0200558 A1 8/2010 Liu et al.
2010/0279177 A1 11/2010 Yang
2010/0282458 A1 11/2010 Ann et al.
2010/0282736 A1 11/2010 Koch et al.
2011/0036828 A1 2/2011 Feng et al.
2011/0036829 A1 2/2011 Fugetsu et al.
2011/0041246 A1 2/2011 Li et al.
2011/0046703 A1 2/2011 Chen
2011/0068098 A1 3/2011 Li
2011/0084054 A1 4/2011 Bahr
2011/0096902 A1 4/2011 Anbe
2011/0232888 A1 9/2011 Sasaki
2012/0168430 A1 7/2012 Seo
2013/0001212 A1 1/2013 Mangoubi
2013/0020314 A1 1/2013 Hashimoto et al.
2013/0064528 A1 3/2013 Bigex et al.
2013/0082043 A1 4/2013 McCarthy

(56) References Cited

U.S. PATENT DOCUMENTS

| | | | |
|---|---|---|---|
| 2013/0168382 | A1 | 7/2013 | Teramoto et al. |
| 2013/0186884 | A1 | 7/2013 | Barfuss et al. |
| 2013/0228562 | A1 | 9/2013 | Chen |
| 2013/0233476 | A1 | 9/2013 | Glancy et al. |
| 2013/0277359 | A1 | 10/2013 | Fukuda et al. |
| 2013/0319997 | A1 | 12/2013 | Chao |
| 2014/0001170 | A1 | 1/2014 | Son et al. |
| 2014/0151353 | A1 | 6/2014 | Steinwandel et al. |
| 2014/0187140 | A1 | 7/2014 | Lazanja et al. |
| 2014/0231404 | A1 | 8/2014 | Struck |
| 2014/0312027 | A1 | 10/2014 | Augustine et al. |
| 2014/0316494 | A1 | 10/2014 | Augustine et al. |
| 2014/0316495 | A1 | 10/2014 | Augustine et al. |
| 2015/0021315 | A1 | 1/2015 | Blanke |
| 2015/0024168 | A1 | 1/2015 | Son |
| 2015/0163856 | A1 | 6/2015 | Jeon et al. |
| 2015/0245729 | A1 | 9/2015 | Morin et al. |
| 2015/0267359 | A1 | 9/2015 | Berger |
| 2015/0373782 | A1 | 12/2015 | Kang et al. |
| 2016/0021704 | A1 | 1/2016 | Elverud |
| 2016/0021945 | A1 | 1/2016 | Richmond |
| 2016/0059670 | A1 | 3/2016 | Satzger et al. |
| 2016/0060871 | A1 | 3/2016 | Kulkarni et al. |
| 2016/0089863 | A1 | 3/2016 | Fetfatsidis et al. |
| 2018/0279416 | A1* | 9/2018 | Sajic ..... H05B 1/0238 |
| 2018/0288830 | A1 | 10/2018 | Sajic |

FOREIGN PATENT DOCUMENTS

| | | | |
|---|---|---|---|
| DE | 9200124 | U1 | 5/1992 |
| DE | 4321474 | A1 | 1/1995 |
| EP | 0188160 | A1 | 7/1986 |
| EP | 0278139 | A1 | 2/1987 |
| EP | 0505936 | A2 | 9/1992 |
| EP | 0719074 | A2 | 6/1996 |
| EP | 0732038 | A1 | 9/1996 |
| EP | 0808640 | A2 | 11/1997 |
| EP | 0894065 | A1 | 2/1999 |
| EP | 0926925 | A1 | 6/1999 |
| EP | 0963138 | A2 | 12/1999 |
| EP | 0979023 | A1 | 2/2000 |
| EP | 0894417 | B1 | 12/2000 |
| EP | 1132028 | A1 | 9/2001 |
| EP | 0894225 | B1 | 12/2001 |
| EP | 1298961 | A2 | 4/2003 |
| EP | 0959749 | B1 | 7/2003 |
| EP | 0983437 | B1 | 10/2003 |
| EP | 1438727 | A1 | 7/2004 |
| EP | 1467598 | A2 | 10/2004 |
| EP | 1515094 | A2 | 3/2005 |
| EP | 1525281 | A1 | 4/2005 |
| EP | 1601235 | A2 | 11/2005 |
| EP | 1602302 | A2 | 12/2005 |
| EP | 1652454 | A2 | 5/2006 |
| EP | 1689575 | A1 | 8/2006 |
| EP | 1796432 | A1 | 6/2007 |
| EP | 1826119 | A2 | 8/2007 |
| EP | 1844526 | A1 | 10/2007 |
| EP | 1845018 | A2 | 10/2007 |
| EP | 1864552 | A2 | 12/2007 |
| EP | 1865553 | A2 | 12/2007 |
| EP | 1897411 | A1 | 3/2008 |
| EP | 1900254 | A1 | 3/2008 |
| EP | 1325665 | B1 | 4/2009 |
| EP | 1864551 | B1 | 5/2009 |
| EP | 2099596 | A2 | 9/2009 |
| EP | 2109343 | A2 | 10/2009 |
| EP | 2123120 | A2 | 11/2009 |
| EP | 2127473 | A2 | 12/2009 |
| EP | 2023688 | B1 | 3/2010 |
| EP | 2200396 | A1 | 6/2010 |
| EP | 1956303 | B1 | 7/2010 |
| EP | 2249617 | A1 | 11/2010 |
| EP | 2293050 | A1 | 3/2011 |
| EP | 2329682 | A2 | 6/2011 |
| EP | 2422949 | A1 | 2/2012 |
| EP | 2430878 | A1 | 3/2012 |
| EP | 2461643 | A1 | 6/2012 |
| EP | 2548717 | A2 | 1/2013 |
| EP | 2551894 | A1 | 1/2013 |
| EP | 2558761 | A1 | 2/2013 |
| EP | 2559318 | A1 | 2/2013 |
| EP | 2608630 | A1 | 6/2013 |
| EP | 2656685 | A1 | 10/2013 |
| EP | 2689194 | A2 | 1/2014 |
| EP | 2160072 | B1 | 5/2014 |
| EP | 2558274 | B1 | 8/2014 |
| EP | 2827069 | A2 | 1/2015 |
| EP | 2900035 | A1 | 7/2015 |
| EP | 29559757 | A1 | 12/2015 |
| EP | 2493678 | B1 | 3/2016 |
| EP | 2283177 | B1 | 4/2016 |
| EP | 3013119 | A1 | 4/2016 |
| GB | 2493001 | A | 1/2013 |
| WO | 0143507 | A1 | 6/2001 |
| WO | 2006103081 | A1 | 10/2006 |
| WO | 2013011306 | A1 | 1/2013 |
| WO | 2014202768 | A1 | 12/2014 |
| WO | 2016113633 | A1 | 7/2016 |
| WO | 2017068416 | A1 | 4/2017 |
| WO | 2017216631 | A2 | 12/2017 |

OTHER PUBLICATIONS

Canadian Examination Report for Canadian Application No. 3,001,643, dated Jan. 29, 2020, 4 pages.

International Search Report and Written Opinion for International Application No. PCT/IB2016/001584, dated Feb. 8, 2017—12 pages.

Extended European Search Report for European Application No. 20161190.2, dated Jul. 2, 2020, 12 pages.

International Preliminary Report on Patentability for International Application PCT/IB2016/000095, dated Jul. 18, 2017, 9 Pages.

International Search Report for International Application No. PCT/IB2016/000095, dated May 12, 2016, 11 Pages.

LaminaHeat: PowerFilm, www.laminaheat.com, 2 pages.

Chemitex Data Sheet, www.chmcomposites.com, 1 page.

"How Do Heated Panels Work," 4 pages, downloaded from Internet, Jul. 15, 2019, https://www.compositeadvantage.com/blog/how-do-heated-panels-work.

Canadian Office Action for Canadian Application No. 2,973,557, dated Dec. 17, 2019, 4 pages.

Chinese Office Action for Application No. 201680009737..7, dated Jan. 21, 2020 with translation, 15 pages.

Chinese Office Action for Application No. 201680009737.7, dated Apr. 27, 2020, with translation, 7 pages.

International Search Report and Written Opinion for International Application No. PCT/EP2020/053133, dated May 12, 2020, 14 pages.

* cited by examiner

LAMINAR HEATING ELEMENTS WITH CUSTOMIZED OR NON-UNIFORM RESISTANCE AND/OR IRREGULAR SHAPES AND PROCESSES FOR MANUFACTURE

CROSS-REFERENCE TO RELATED APPLICATIONS

This application is a continuation-in-part of PCT Application Ser. No. PCT/IB2016/001584, filed Oct. 14, 2016, titled "LAMINAR HEATING ELEMENTS WITH CUSTOMIZED OR NON-UNIFORM RESISTANCE AND/OR IRREGULAR SHAPES, AND PROCESSES FOR MANUFACTURE," which claims priority from U.S. Provisional Application No. 62/243,240, titled "PROCESS FOR CUSTOMIZING THE RESISTANCE OF A LAMINAR HEATING ELEMENT, AND LAMINAR HEATING ELEMENTS MANUFACTURED THEREBY", filed Oct. 19, 2015, and from U.S. Provisional Application No. Application No. 62/243,271, titled "SEGMENTED LAMINAR HEATER," filed Oct. 19, 2015, all of which are incorporated by reference herein in their entireties.

BACKGROUND OF THE INVENTION

Existing heater mats or heater films offer only a limited ability to change the electrical resistance properties that govern power output performance. For example, changing the resistance of wire resistance heaters is limited to changing the wire diameter. Changing the resistance of other heater films, such as conductive ink printed plastic films, is limited to changing the type of coating or coating thickness, which provides only limited variability.

Resistive wires used in heaters have a relatively high resistivity and/or a wide temperature range. Because power output is inversely proportional to resistance, increasing the power output typically requires an increase in voltage.

Laminar heating elements such as but not limited to those developed by LaminaHeat® of Greenville, S.C., such as PowerFilm™ or PowerFabric™ heaters (hereinafter referred to as "laminar heaters" or "flat heaters," generally, to refer to any type of materials of construction and any manufacturer, without limitation, characterized by heaters in the shape of a sheet, film, or fabric in which the thickness is much smaller than the length and width) are very efficient heaters and provide uniform heat over the entire surface of the heater. Varying the electrical resistance for heaters of this type, which comprise non-metallic film or fabrics, has historically required changing the weight percentage of conductive fibers in the heater material.

All the above methods involve changing the intrinsic material properties for each heating application and complicates the manufacturing process for commercial applications. Thus, there is a need in the art to provide laminar heaters with customizable heating properties in one or more portions of the heater.

Laminar heaters, generally, have also historically been limited to rectangular shapes, such as heater 100 is shown in FIG. 1, so that busbars 102 remain a constant width W apart to maintain a constant current density in current flowing along arrow A. Thus, historically, it has been difficult to design a non-regular flat sheet heater that provides a uniform heat-up and heat distribution.

Accordingly, there is a need in the art for irregularly shaped flat heaters and methods for making them that provide uniform heat up and distribution and/or flat heaters with a heat distribution that can be readily customized or tailored to suit a particular purpose.

SUMMARY OF THE INVENTION

Figure 1:
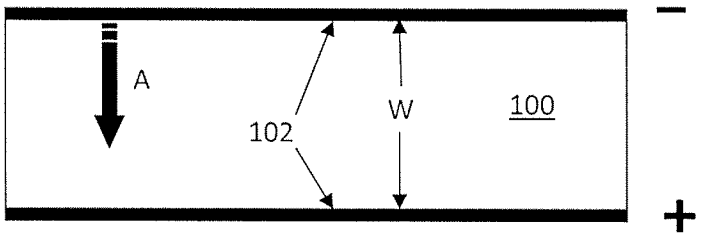
FIG. 1 (PRIOR ART)
FIG. 1 illustrates the schematic layout and current flow in a typical laminar heater.

In one aspect of the invention, a laminar heater comprises a heating element having at least two segments. Each segment comprises a pair of electrically conductive busbars connected to opposite ends of an electrically conductive laminar heating element segment. A first busbar is connected to a first end of a first segment, a second busbar is connected to a second end of the first segment and a second end of a second segment, and a third busbar is connected to a first end of the second segment. The second busbar comprises a continuous electrically conductive strip connected to both the first and the second segments in which the first and third busbars are separated from one another and the first and second segments are separated from one another by a first gap. The laminar heater may further comprise a first insulating layer over one surface of the heating element and a second insulating layer over an opposite surface of the heating element. The first gap may be substantially filled with insulating material, such as in embodiment in which the first and second insulating layers collectively provide a continuous layer extending over the first and second segments, over the first, second, and third busbars, and into the first gap.

Embodiments of the segment laminar heater as described herein may be generally characterizes as having N segments, N+1 busbars, and N−1 gaps, in which the N segments are electrically connected to one another in series from a first busbar on a first segment to an N+1th busbar on an Nth segment. In some embodiments, half of the N+1 busbars may be disposed in a linear arrangement along a first line and the other half of the N+1 busbars may be disposed in a linear arrangement along a second line, in which the first line and the second line are parallel to one another. In other embodiments, the first line and the second line may be non-parallel to one another. In particular, at least one portion of a first busbar attached to a first edge of a first segment may be non-parallel to at least one portion of a second busbar attached to an opposite edge of the first segment.

Still another aspect of the invention comprises a method for making a segmented laminar heater as described above, comprising the steps of providing a continuous sheet of the electrically conductive laminar heating element material having a width and a length from a first edge to a second edge; disposing a pair of electrically conductive busbars adjacent opposite edges of the continuous sheet, each busbar extending the width of the sheet; and slitting the continuous sheet and connected busbar strips in a first location extending through the first edge but not through the second edge, to define the first gap, the first and second segments, and the first and third busbars. The method may further comprise applying first and second insulating layers over the opposite surfaces of the heating element, including in such a manner that the insulating material substantially fills the first gap with insulating material. For a laminar heater generally characterized as having N segments, N+1 busbars, and N−1 gaps, in which the plurality of segments are electrically connected to one another in series from a first busbar on a first segment to an N+1th busbar on an Nth segment, the method may comprise slitting the continuous sheet in alternating locations such that adjacent slits extend through opposite edges of the sheet to define the N segments, N−1 gaps, and N+1 busbars.

In yet another aspect of the invention, a heater comprising a pair of electrically conductive busbars connected to opposite sides of an electrically conductive laminar heating element material, has a first area with a first electrical resistance and a second area with a second electrical resistance, wherein the first area has a first open area percentage and the second area has a second open area percentage different than the first open area percentage. One of the open area percentages may be zero, or the open area percentage of both may be non-zero. One or more of the open area percentages may be defined by a perforation pattern. For example, a first area may have a first perforation pattern defining a first non-zero open area percentage and the second area may have a second perforation pattern defining the second non-zero open area percentage. The first area may have a first heat output per unit area and the second area may have a second heat output per unit area, wherein the first heat output and the second heat output are, on average, essentially the same within a predetermined amount of tolerance. The busbars have a first average distance from one another in the first area and a second average distance, different from the first average distance, from one another in the second area, such as where the busbars are spaced from one another in a non-parallel configuration. In a configuration in which the laminar heating element comprises a non-metallic heating element comprising an electrically-conductive non-woven fiber layer having the electrically conductive busbars connected thereto, wherein the fiber layer and busbars are disposed between two outer insulating layers, the perforations may extend through the non-metallic heating element and the outer insulating layers or the perforations may be disposed in the non-metallic heating element, with insulating material disposed within the perforations. The first area and the second area may be connected to one another by a third area having an open area percentage that defines a gradient between the first open area percentage and the second open area percentage.

Another aspect of the invention comprises a heating system comprising a plurality of the laminar heaters as described herein, connected to a controller and disposed on a surface for providing heat to the surface. In certain embodiments, the system may comprise a plurality of heaters having a wedge shape in which a first edge is not parallel to a second edge, having a first busbar or set of busbars disposed along the first edge and a second busbar or set of busbars disposed along the second edge, wherein at least a first heater and a second heater adjacent thereto in the plurality of heaters are arranged with the second busbar or set of busbars of the first heater parallel to the first busbar or set of a busbars of the second heater.

Yet another aspect of the invention comprises a de-icing system comprising the heating system as described herein, wherein the surface to be heated is a non-planar surface, such as a satellite dish.

Still another aspect of the invention comprises a process for customizing electrical resistance of a heater or a portion thereof, in which the heater comprises a pair of electrically conductive busbars connected to opposite edges of an electrically conductive laminar heating element material. The process comprising the step of perforating the laminar heating element material in a pattern having an open area percentage corresponding to a desired customized level of electrical resistance. For a laminar heating element comprising a non-metallic heating element comprising an electrically-conductive non-woven fiber layer having the electrically conductive busbars connected thereto, the fiber layer and connected busbars having a collective upper surface and a collective lower surface, the process may further comprise the step of applying a first insulating layer over the collective upper surface and a second insulating layer over the collective lower surface. The step of applying the first and second insulating layers may be performed after the perforating step, in which case the step of applying the insulating layers may comprise insulating material filling or partially filling the perforations, or the insulating layers may be performed prior to the perforating step such each perforation extends through the insulating layers and the non-woven fiber layer.

Various embodiments of the invention may comprise segmented heaters having segments with different perforation patterns and processes for manufacture that include conducting a perforation step.

DETAILED DESCRIPTION OF THE INVENTION

Referring now to the figures, FIG. 1 shows an exemplary heater, such as a LaminaHeat® PowerFilm™ carbon fiber film heater, such as Model PFI20-NP-PETG-550C1000, which is has a thickness of 200 micron and a weight 250 grams per square meter (gsm). The standard electrical resistance of the film heater is 20 ohms per square (ohmsq).

Heating Element Core Construction

Exemplary heaters that may particularly benefit from various aspects of the invention as claimed and described herein may include non-metallic conductive film heaters such as LaminaHeat® PowerFilm™ or PowerFabric™ heaters, produced by LaminaHeat of Greenville, S.C. PCT Published Application No. WO 2016/113633 ("the '633 WO Publication), which claims priority from U.S. Provisional Patent Application Ser. No. 62/102,169, both of which are incorporated herein by reference in their entireties, provide a detailed disclosure of exemplary heater embodiments, the core which is referred to as an illustrative example herein, without limitation. Embodiments of the invention may include any construction, or functional portion thereof, disclosed in the '633 WO Publication to which the teachings of this invention are implemented. It should be understood that the core heater elements described herein may be used in conjunction with any number of other coatings, plies or layers, such as but not limited to those described in the '633 WO Publication, Thus, an exemplary heater 200 may comprise a plurality of layers 210-240, as shown in FIG. 2A and described below.

Layers 210 and 240 refer to an outer reinforcing or insulating layer, such as, for example, an insulating polymer, which may be in extruded or coated form. Typical polymers, without limitation may include (PET) Polyethylene terephthalate, PP (polypropylene), PC (polycarbonate), PE (polyethylene), Silicone (SI), PEI (polyetherimide), PEEK (polyetheretherketone), PES (polyphenylene sulphide), TPU (Polyurethane thermoplastic), or PA Polyamide (Nylon). Typical thickness of the insulating polymer is 50-100 micron. Layers 210 and 240 may be the same materials, or different materials, and one or both may not be present certain constructions, or rather than referring to a single discrete layer, may refer to a matrix or plurality of other layers in which the remaining layers 220-230 are embedded or/encapsulated.

Figure 2B:
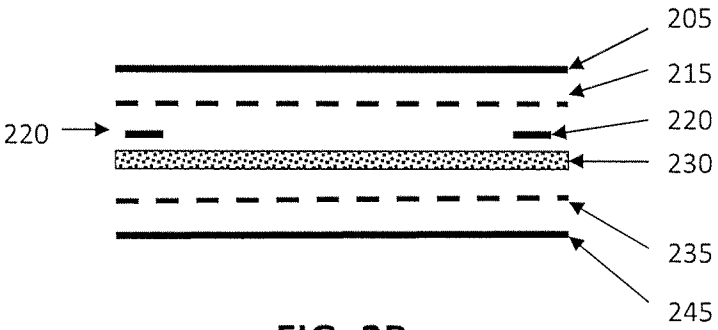
FIG. 2B illustrates a second exemplary heating element cross section.
Figure 2A:
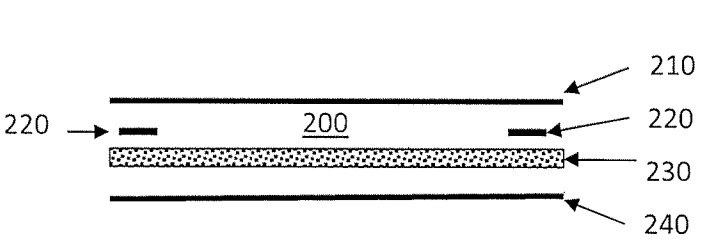
FIG. 2A illustrates a first exemplary heating element cross section.

In other embodiments, such as shown in FIG. 2B, instead of coating layers 210 and 240, the outer layers may comprise fabric layers 205 and 245 that are adhesively bonded by layers 215 and 235, respectively, to layers 220-230. For example, outermost layers 205, 245 may comprise a non-woven fabric, felt or veil, such as having a fiber length in a range of 6-25 mm, that are adhesively bonded to layers 230 and 240 via a solid film/adhesive layer 215, 235 having an adhesive on both sides, which film/adhesive layer acts as a bonding layer and a moisture barrier between layer 205 and the upper surface of layers 220/230 and between the lower surface of layer 230 and layer 245, as depicted in FIG. 2B.

Layer 230 refers to a resistive heater sheet, such as a sheet that comprises randomly orientated conducting fibers, such as carbon fibers. In one embodiment, the carbon fiber resistive heater sheet comprises a non-woven fiber layer comprising a wet-laid layer of individual unentangled fibers comprising conductive fibers, non-conductive fibers (such as glass fibers), or a combination thereof. In preferred embodiments, the fibers have an average length of less than 12 mm and the fiber layer has an absence of conductive particles. Typical density of this layer may be in a range of 8-60, more preferably in the range of 15-35, grams per square meter. The heater layer preferably has a uniform electrical resistance in any direction. The fiber layer may further comprise one or more binder polymers and/or a fire retardant. Each of the conductive fibers and/or each of the non-conductive fibers may have a length in the range of 6-12 mm. One or more of the plurality of conductive fibers may comprise a non-metallic fiber having a metallic coating. The fiber layer may consist essentially of individual unentangled fibers. The composition of layer 240 is not limited to any particular construction, functional characteristics, or density, however.

The heater layer may also include a plurality of perforations that increase the electrical resistance of the fiber layer relative to a similar layer without such perforations, as described in more detail herein later. The perforations, if present, may have a uniform density creating a uniform open area throughout the sheet, or the density and open area may vary along the sheet gradually or stepwise, as described in more detail below. Certain aspects of the invention are not limited to the presence or absence of perforations, or to any particular uniform or non-uniform pattern, size, or spacing thereof.

Layer 220 refers to at least two conductive strips (preferably copper) that serve as busbars and are electrically connected at opposite ends of layer 230. Electrical wires (not shown) connected (such as, but not limited to, soldered or mechanical connections) to the busbars enable a voltage to be applied to the heater. In an exemplary embodiment, the strips may be, for example, copper, 10-19 mm wide, 50 micron thick. The conductive strips may be applied as a coating on layer 230. Accordingly, conductive strips may also have perforations, such as if layer 230 has perforations and the strips are coated over the perforated layer, in which case the conductive coating may fill one or more of the perforations in layer 230, or layers 220 and 230 may be perforated together after the coating has been applied.

As will be understood to one of skill in the art, the term non-woven fabric as used in the Textile Manufacturing Industry denotes fabrics such as felt or veils that are neither woven nor knitted. Typically, non-woven fabric comprise fabric-like materials made from long or short fibers bonded together by chemical, mechanical, heat or to solvent treatment. The invention is not limited to the heater construction described, and may have more or fewer layers, or layers having properties different than those described in the foregoing example.

In one exemplary manufacturing process, electrically conductive layer 230 may be manufactured in a continuous process, such as a wet paper process, and copper strip or other conductive busbars 220 are laminated to the carbon mat, such as by using computer controlled automated tape laying machines, which are programmable for different shapes.

Segmented Heater Embodiments

Figure 3A:
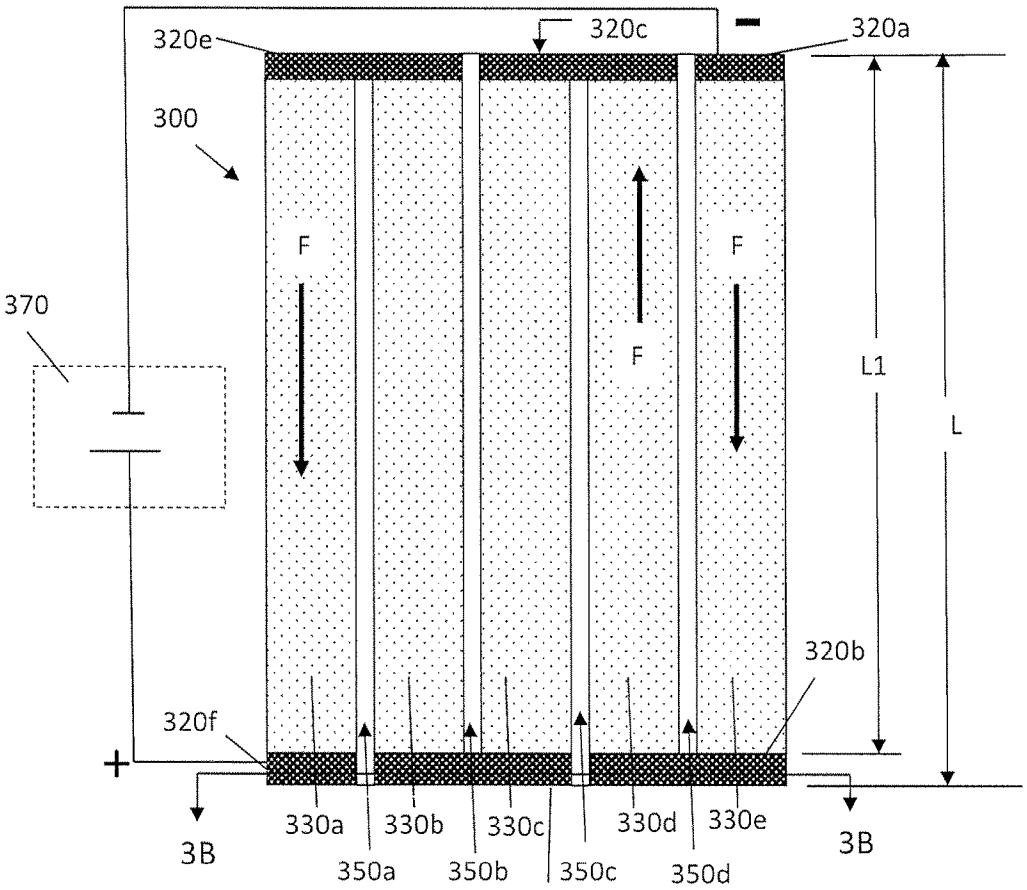
FIG. 3A illustrates a first embodiment of a segmented heater design.
Figure 3B:
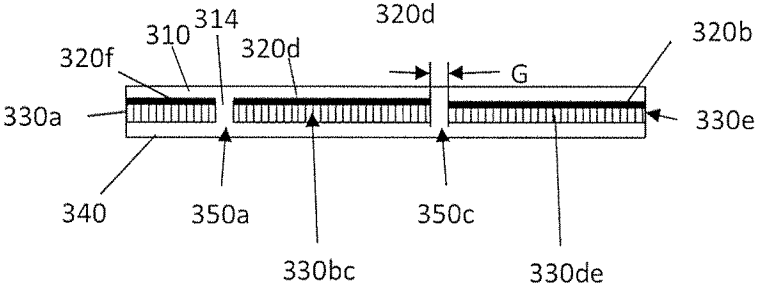
FIG. 3B illustrates the cross section of the exemplary segmented heater design of FIG. 3A.

Referring now to FIGS. 3A and 3B, in accordance with aspects of the invention, a continuous heating element having a first continuous conductive busbar extending from a right side to a left side of the sheet at the upper edge, and a second busbar at the lower edge, may then be slit in one or more places to create gaps 350*a-d* to create adjacent discrete heater segments 330*a-e* with discrete connecting busbars 320*a-f* as illustrated in FIG. 3. Each gap preferably has a width G of approximately 3 mm. Each slit 350*a-d* may be created by any method known in the art, such as but not limited to a punching operation, a slitting operation with a blade of suitable thickness, a laser cutting operation, or any other method known in the art.

As shown in FIG. 3B, each slit preferably has a length L1 that is shorter than the overall length L of heater element 300, such that adjacent segments (e.g. 330*a* and 330*b*; 330*b* and 330*c*) remain attached to one another on alternating edges, with unbroken busbar segments between connected adjacent segments. For example, as shown in FIGS. 3A and 3B, segments 330*b* and 330*c* are connected to one another at the lower edge of the segmented sheet in connecting section 330*bc* with busbar 320*d* disposed on the connecting portion, as slit 350*b* extends through the top edge of the sheet but not through the bottom edge (stopping at the busbar). Similarly, segments 330*d* and 330*e* are similarly connected at connecting section 330*de* with busbar 320*b* disposed on the connecting portion. By contrast, segments 330*a* and 330*b* have a gap between them formed by slit 350*a* at the lower edge of the sheet (but are connected to one another at the top edge), and the gap formed by slit 350*a* also electrically isolates busbar segment 320*f* from busbar segment 320*d*. Likewise, slit 350*c* electrically isolates busbar segment 320*b* from busbar segment 320*d*.

Thus, as shown, each pair of adjacent segments (e.g. 330*a* and 330*b*) has a first busbar (e.g. 320*f*) connected to a first end of a first segment, a second busbar (e.g. 320*e*) connected to a second end of the first segment (330*a*), and a second end of a second segment (330*b*), and a third busbar (350*d*) connected to a first end of the second segment (330*b*), the second busbar (320*e*) comprising a continuous electrically conductive strip connected to both the first and the second segments, the first and third busbars (320*f* and 320*d*, respectively) separated from one another and the first and second segments (330*a* and 330*b*) separated from one another by a first gap (350*a*). This structure can generally be described as a heater comprising a plurality N segments, a plurality N+1 busbars, and a plurality N−1 gaps, in which the plurality of segments are electrically connected to one another in series from a first busbar (e.g. 320*a*) on a first segment (330*e*) to an N+1th busbar (320*f*) on an Nth segment (330*a*).

A segmented heating element, such as element 300 may then be coated with a polymeric insulating film or fabric/textile material, such as layers 310 and 340 (similar to layers 210 and 240 as described with respect to FIG. 2A, or layers 205, 215 and 235, 245 as described with respect to FIG. 2B), in a continuous or discrete laminating press process to complete the final segmented product. The insulating film of layers 310 and 340 is preferably of a nature that gaps (e.g. formed by slits 350*a* and 350*c* as shown in FIG. 3B) between adjacent segments are substantially filled with electrically insulating material 314. Insulating material 314 may comprise a material in which top layer 310 and bottom layer 340 have bonded together in a way that they are no longer discretely separable, or the layers may still be discretely identifiable. In any event, however, a continuous layer of insulating material preferably extends over the upper and lower surfaces of the heating element and into the gaps between adjacent segments. Substantially filling the gap decreases the potential for electrons to jump across the gap between adjacent segments relative to the potential for such electron jumping prior to such substantially filling. In an application in which the insulating film comprises a fabric/textile, such as is described and depicted with respect to FIG. 2B, the fabric textile layers 205, 245 may be bonded to the segmented product comprising layers 220 and 230 using an insulating adhesive in layers 215, 235 (which may or may not include a film as a vehicle for that adhesive), such that the insulating material 314 that substantially fills the gaps between adjacent segments comprises the adhesive of layers 215 and 235.

It should be understood that although an exemplary gaps of 3 mm between adjacent segments are suggested herein as a suitable size for an exemplary material intended for use in a particular power range, the gap is not limited to any size, but must be of a minimum size to sufficiently electrically isolate adjacent segments from one another so that no electrons can jump across the gap for the range of expected operation. As will be understood to one of skill in the art, designs intended for relatively higher power operation may have relatively larger gaps than designs intended for relatively lower power operation, all other factors being equal. It should also be understood that the minimum size of the gap may be greater or lesser, depending upon the characteristics of the insulating film and the confidence with which the insulating process is expected to provide a desired amount of insulation in the gap.

The segmented heater can be represented as number of constituent heaters, called segments, connected electrically in series such that when a voltage is applied to the positive and negative terminals, a constant current will flow thru all the segments. The total resistance of resistors in series is equal to the sum of their individual resistances. In a series circuit, the current is the same for all elements. Thus, because the current in each segment is constant, the heat output density in power per unit area (e.g. watts/m2) is constant for each segment, and hence, the temperature distribution is even and consistent across the entire sheet.

Figure 4A:
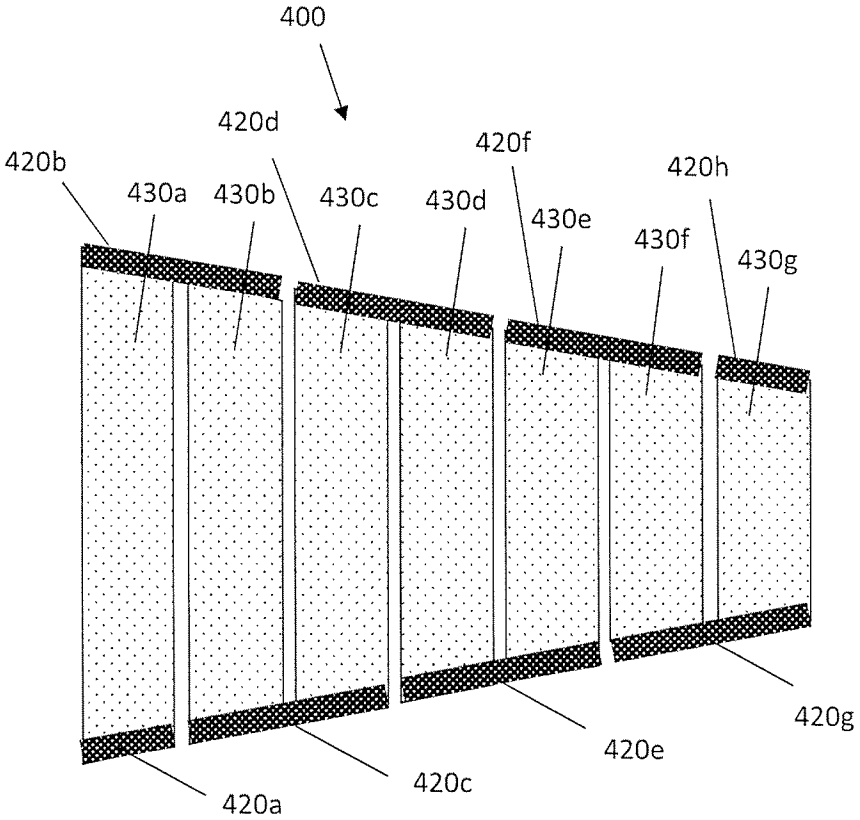
FIG. 4A illustrates an embodiment of a segment heater having an irregular shape with non-parallel busbars.

As shown in FIG. 3A, the busbars at opposite ends of the heating element 300 are parallel to one another. That is, busbars 320*a,c,e,g* can be characterized as disposed along a first line (not shown) and busbars 320*b,d,f,h* can be characterized as disposed along a second line (not shown), wherein the lines formed by each set of opposing busbars are parallel. For application to non-rectangular planar shapes, as shown in FIG. 4A, segmented heater 400 may comprise a plurality of segments 430*a-g* having busbars 420*a-h*, wherein the busbars on opposite ends of the heating element are non-parallel. Thus, for example, the line (not shown) formed by busbars 420*a,c,e,g* are not parallel to the line (not shown) formed by busbars 420*b,d,f,h*, and therefore each segment 430*a-g* has a different average length between the non-parallel busbar segments located at opposite ends of the respective segments. Such a construction with non-parallel opposing busbars may be well suited to heat an irregular shape or area. Thus, for example, segment 430*a* has a greater average length from busbar 420*a* to busbar 420*b* than segment 430*b* has from busbar 420*b* to busbar 420*c*, because busbars 420*a* and 420*c* are not parallel to busbar 420*b*.

It should be understood that although shown in a wedge shape in which each set of opposing busbars is linearly arranged along the same line, the invention is not limited to a wedge shape. Thus, any number of infinite non-rectangular shapes may have at one portion of a first busbar attached to a first edge of a first segment that is non-parallel to at least one portion of a second busbar attached to an opposite edge of the first segment. A single heater shape may have one or more segments in which at one portion of the busbar attached to one edge of the segment is non-parallel to at least one portion of the busbar attached to the opposite edge of segment, and one or more other segments in which at one portion of a first busbar attached to a first edge of that other segment is non-parallel to at least the portion of the busbar attached to the opposite edge of that other segment.

In some embodiments, one or more of the segments 430*a-g* may also be provided with a perforation pattern that is different from another of the segments to customize the resistance (and therefore the heat output per unit area) within the segment, such as are described in more detail below.

One advantage of a segmented design is that heaters can be made with large electrical resistance, which is an advantage for applications having high supply voltages (e.g. in the range of 400-600 volts), such as but not limited to, de-icing applications of windmill blades or satellite dishes.

Figure 5:
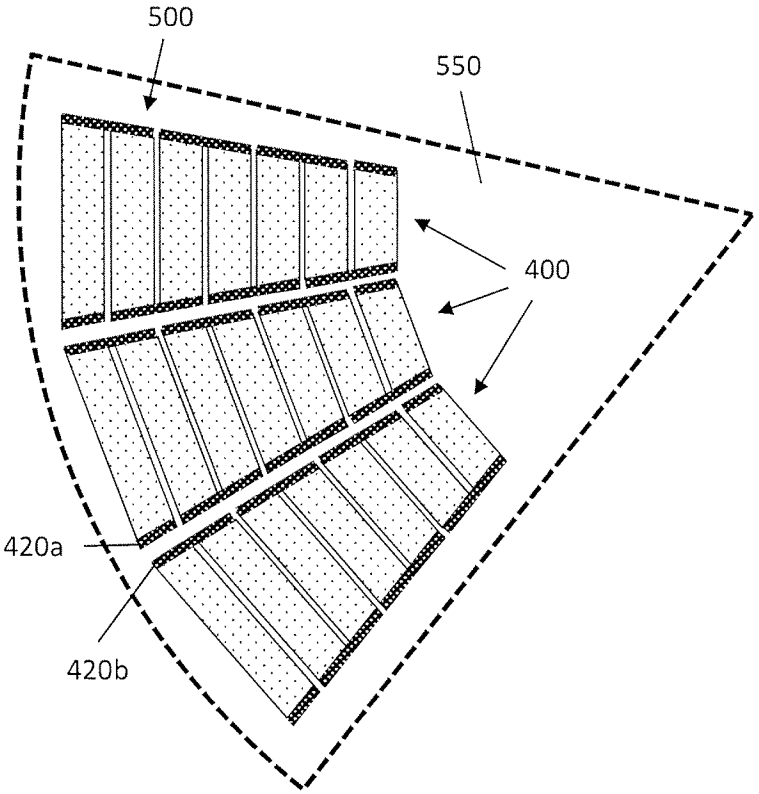
FIG. 5 illustrates an exemplary heater system comprising a plurality of the segmented heaters of FIG. 4A.

Thus, as illustrated in FIG. 5, a heating system 500 may comprise a plurality of segmented laminar heaters 400, connected to a common electrical controller (not shown) to provide heating over a surface. For example, a plurality of wedge shaped heaters 400 may be aligned as shown in FIG. 5 so that at least one upper busbar segment (e.g. 420*b*) of a first heater is parallel to at least one lower busbar segments (e.g. 420*a*) of an adjacent heater, as depicted in FIG. 5. One of skill in the art will understand that while only three heaters shapes are depicted for illustration, arrangement of a sufficient number of heaters of similar shape enables construction of an essentially circular arrangement of heaters, such as would be suitable for lining a concave, non-planar surface 550 (only a portion of which is depicted), such as, for example, a satellite dish.

The heater busbars (e.g. 320*a* and 320*f* in FIG. 3A) at the beginning and end of each series of segments are typically connected to a power supply and controller (depicted schematically as 370 in FIG. 3A), the controller configured to apply a voltage from the power supply to the busbars. The controller may apply the voltage based on one or more temperature sensors (not shown) placed on the surface to be heated or based upon other feedback and/or feed forward control systems. For example, a temperature input device (not shown) may set a desired amount of heat to be produced by the heater device; and a temperature sensor (not shown) may detect the heat produced by the heater in response to an input from the temperature input device, and transmit a signal to the controller indicating the amount of detected heat. The controller is typically configured to vary the voltage applied to the busbars to produce a predetermined amount of heat via the heater.

Modification of Resistance Using Different Open Area Percentages

The laminar heaters as described herein are essentially two-dimensional systems in which the thin films of the laminar heaters may be considered as two-dimensional entities for purposes of defining resistance. Current flows between opposing busbars. The term "resistance" refers to resistance to current flow along the plane of the sheet, not perpendicular to it. In a regular three-dimensional conductor, the resistance can be written as: R=pL/A where p is the resistivity, A is the cross-sectional area and L is the length. For a laminar heating element as described herein, the cross-sectional area A is a multiple of the width of the sheet W and the sheet thickness t. Thus R=pL/(Wt). Combining the resistivity with the thickness yields: R=(p/t)(L/W)=Rs (L/W), where Rs=p/t. Thus, we refer to Rs as the resistance of the laminar heating element. If the film thickness is known, the bulk resistivity (in Ω cm) can be calculated by multiplying the sheet resistance Rs by the film thickness t in cm.

Resistance for the laminar heaters described herein embody a special case of resistivity for a uniform film thickness. Commonly, resistivity (also known as bulk resistance, specific electrical resistance, or volume resistivity) is in units of Ω·m, which is more completely stated in units of Ω·m2/m (Ω· area/length). Dividing by the sheet thickness (in m) causes the m units to cancel, and represents a special "square" situation yielding an answer in ohms Ω.

An alternative, common unit is "ohms per square" (denoted "Ω/sq"), which is dimensionally equal to an ohm, but is exclusively used for resistance of laminar heating elements, such as those described herein. The reason for the name "ohms per square" is that a square laminar heater with resistance 10 ohm/square has an actual resistance of 10 ohm, regardless of the size of the square. (For a square, L=W, so Rs=R) The unit can be thought of as, loosely, "ohms× aspect ratio."

Example: A 3-unit long (L=3) by 1-unit wide (W=1) (i.e. aspect ratio=3) laminar heating element having a resistance of 21 Ω/sq would have a total resistance of 63Ω (because it is composed of three 1-unit by 1-unit squares). This is the resistance that would be measured if the 1-unit edges were attached to an ohmmeter that made contact entirely over each edge.

Another aspect of the invention comprises a process for customizing the resistance of a laminar heating element. The laminar heating element is perforated with different hole patterns to give resulting different electrical resistance values. This process permits customizing a generic laminar heating element material to provide variable resistance capability. This technology also allows a laminar heating element to be designed with a variable resistance, thereby giving different heating zones within a continuous laminar heating element material itself. Laminar heating elements may thus be designed to easily give a range of electrical resistance values, and thus a range of power outputs from the same material. The subject technology also permits design of laminar heating elements having a non-rectangular shape with uniform (or otherwise carefully designed) heat output over the entire non-rectangular shape.

Figure 7A:
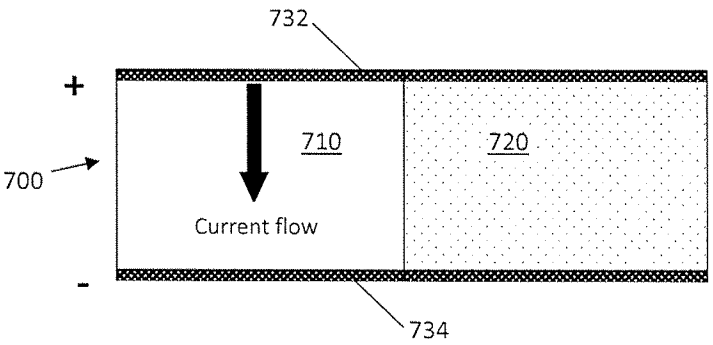
FIG. 7A illustrates an exemplary laminar heater having one section with perforations and another section without perforations.

Referring now to FIG. 7A, heater element 700 comprises a first section 710 having no perforations and a second section 720 having a plurality of perforations. By perforating section 720 of element 700 with the 45° staggered hole pattern 750 shown in FIG. 7B, the resistance is increased from 20 ohmsq for unperforated section 710 to approximately 30 ohmsq in section 720. As a general rule, electrical resistance is related to the open area percentage produced by a hole pattern, as illustrated in the graph shown in FIG. 10. The open area percentage provided by a particular hole pattern is proportional to the square of the hole diameter (D) divided by the distance between hole centers (X), as illustrated in the exemplary graph of FIG. 9, which is a plot of Equation 1 described in more detail below. Thus, the open area can be varied by using different hole patterns, such as, for example, patterns 750, 850 and 890 shown in FIGS. 7B, 8B, and 8C, respectively. Electrical resistance can also be varied by varying the ratio D/X for a particular hole pattern.

Figure 7B:
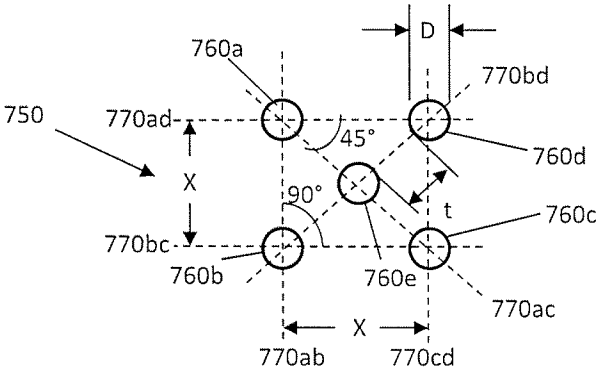
FIG. 7B illustrates an exemplary 45 degree staggered perforation pattern.

For the exemplary pattern 750 illustrated in FIG. 7B, holes 760*a-e* have a diameter D (e.g. 1.5 mm) and are spaced on-center at a spacing X (e.g. 4.5 mm) in the pattern shown, in which holes 760*a* and 760*b* lie along a first line 770*ab*, and 760*b* and 760*c* lie along a second line 770*bc*, and in which 770*ab* and 770*bc* are at a 90 degree angle from one another, and hole 760*e* lies at the intersection of lines 770*ac* and 770*bd*, which lines are aligned at 45 degree angles relative to lines 770*ab* and 770*bc*. This pattern may be referred to as a "45° Staggered hole pattern," and the percent open area of this hole pattern can be calculated in accordance with Equation 1.

$$45° \text{ Staggered hole pattern \% open area} = 157(D^2/X^2) \quad (1)$$

Figure 9:
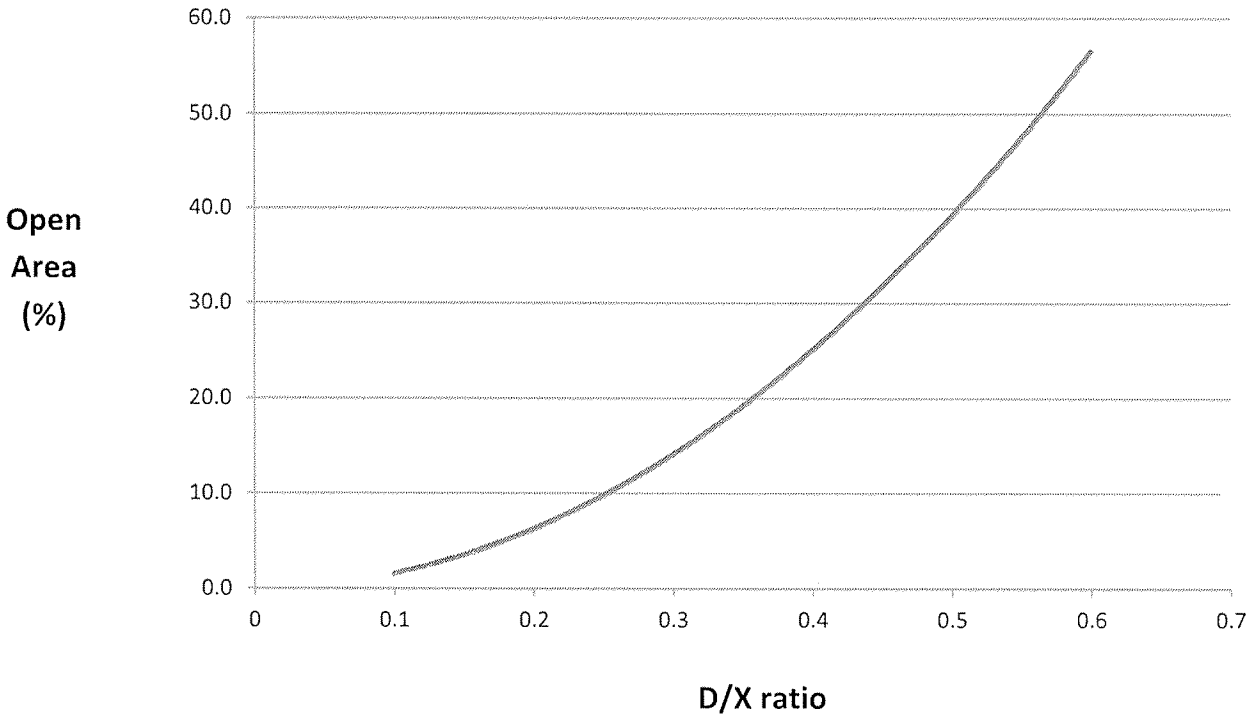
FIG. 9 illustrates an exemplary graph of D/X ratio versus open area percentage in accordance with Equation 1, which relates to the perforation pattern of FIG. 7B.
Figure 10:
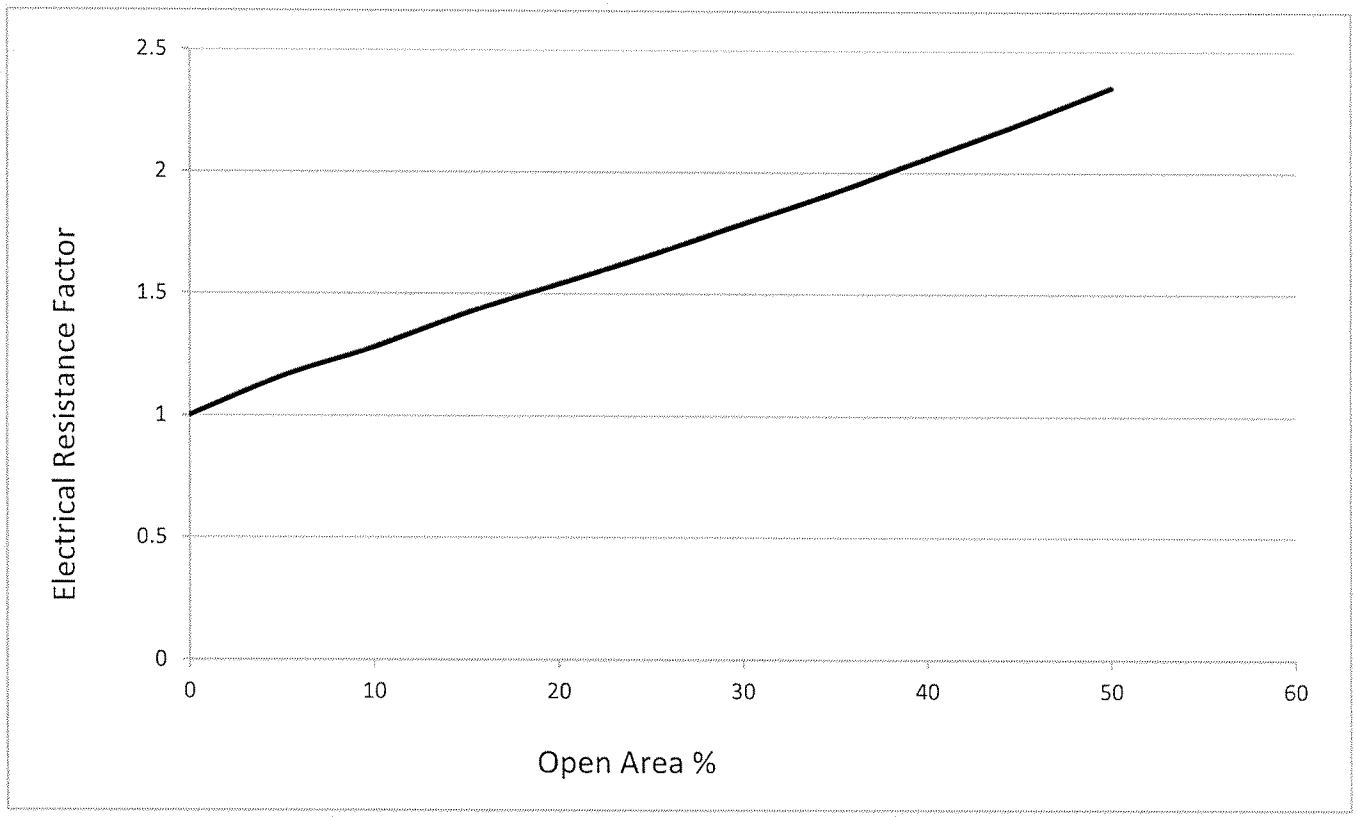
FIG. 10 illustrates an exemplary graph of percentage open area versus electrical resistance factor for a particular laminar heater material.

Thus, for the dimensions shown, this hole pattern has a D/X ratio of 0.33. Per the graph of Equation 1 in FIG. 9, which corresponds to the specific hole pattern shown in FIG. 7B, but for which a similar graph can be devised for any hole pattern, this ratio corresponds to an open area of 17%. Per the graph in FIG. 10, this open area of 17% corresponds to an electrical resistance factor of 1.47. FIG. 10 corresponds to the particular type of heater material used in this example, but an analogous graph can be devised for any type of heater material. Thus, the resistance of section 720 of laminar heating element 700 perforated as shown in FIG. 7B=1.47×20=29.4 ohmsq, relative to section 710 with no perforations, which remains at a resistance of 20 ohmsq.

The film may be perforated using any means known in the art, but a preferred embodiment employs state-of-the-art perforating machines (such as a PAB-H type Perforating Unit manufactured by Burckhardt Gmbh), which uses a stamping press and die process. Perforation processes employing lasers may also be used. Although not limited to any particular type of machine or technology, perforation equipment configurable to provide controlled variation in perforation spacing, size, etc., such as via computer control, are ideal. The holes are preferably punched cleanly such that no conducting fibers protrude into the hole area. The geometry of the hole patterns, particularly geometries characterized by an evenly spaced pattern of holes, is preferred. The hole spacing and size may be tailored to achieve a desired uniformity of heat distribution in the heating element. Uniformity is typically defined by industry standards relevant to a particular application, but as a non-limiting example, some standards may require uniformity in a range of ±5-7% temperature variation over the area of a particular segment of the heating element. As one non-limiting example, suitable heat distribution has been found in embodiments employing the distribution pattern of FIG. 7B with a maximum hole diameter of 6 mm and a minimum closest distance (t) between adjacent holes of 2 mm.

Figure 12B:
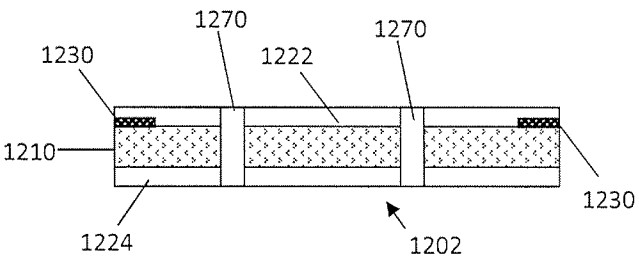
FIG. 12B illustrates an exemplary cross section of an exemplary perforated heater in which the perforations extend through the insulation layers.
Figure 12A:
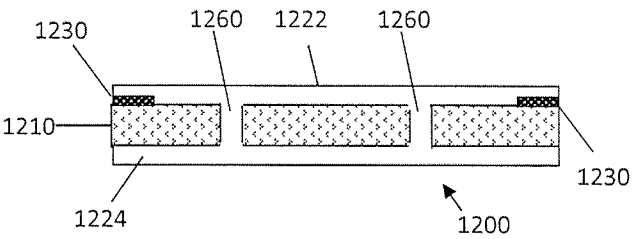
FIG. 12A illustrates an exemplary cross section of an exemplary perforated heater in which the insulating coating on opposite sides of the heater is disposed in one or more of the perforations.

The perforating step may be performed prior to a step of disposing the heating film within upper and lower insulating layers, or after such disposition. In the latter case, the perforations extend through the non-metallic heating element and the outer insulating layers. In the former case, wherein the upper and lower insulating layers comprise an insulating coating, including an insulating adhesive (such as an adhesive for adhering outer insulating fiber layers to an inner carbon veil core, for example), the insulating coating may fill or partially fill some or all of the perforations. Thus, as shown in FIG. 12A, in one embodiment, the resulting heating element 1200 may comprise a core 1210, such as a carbon veil, having conductive busbars 1230, having a collective upper surface that is covered by an upper insulating coating 1222 and a collective lower surface that is covered by a lower insulating coating 1224, wherein perforations 1260 are filled or partially filled with the insulating coating material. The filling may comprise a continuous filling, a filling with a discrete boundary (not shown), or a filling with an air gap between partial fillings that extend from each of top and bottom coating layers 1222, 1224 (also not shown). In an alternate embodiment, illustrated in FIG. 12B, the resulting heating element 1202 may comprise core 1210, upper and lower insulating coatings 1222 and 1224, and perforations 1270 that extend through the core and the insulating coatings. FIGS. 12A and 12B are schematic illustrations in which the relative sizing of the various elements are not to scale. Although not shown, it should be understood that the perforations may also extend through conductive busbars 1230.

Figure 8B:
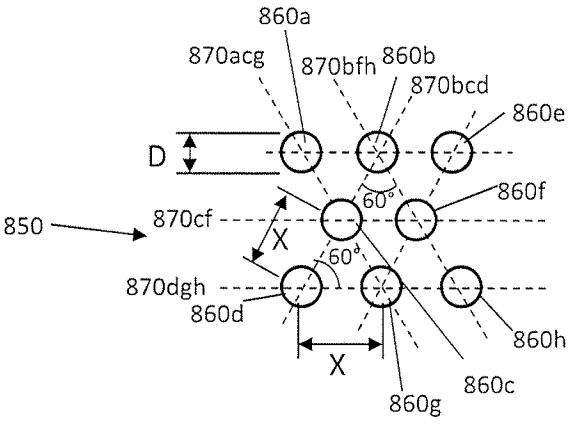
FIG. 8B illustrates an exemplary 60 degree staggered perforation pattern.
Figure 8C:
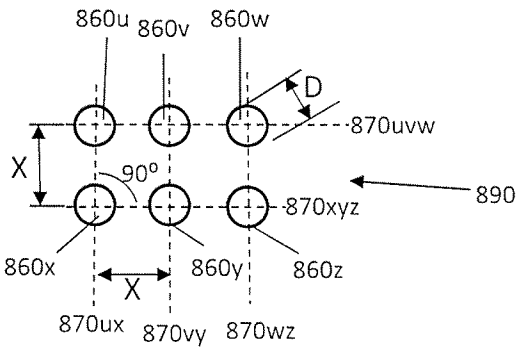
FIG. 8C illustrates and exemplary straight perforation pattern.
Figure 8A:
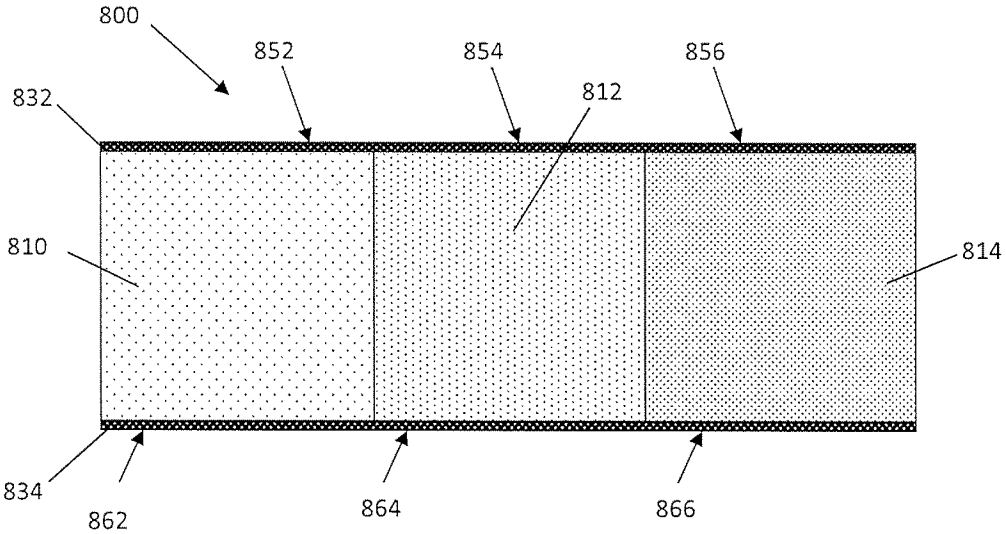
FIG. 8A illustrates an exemplary heater having multiple portions in which each portion has a different perforation pattern.

With reference to FIG. 8A, a laminar heating element 800 having different power outputs in different sections 810, 812, 814 of the heater may be created using different hole patterns in different sections. As used herein the term "different hole patterns" or "different perforation patterns" may refer to any difference between one section relative to another that causes a difference in open area. For example, and without limitation, these differences may comprise differences in hole diameter, hole spacing, arrangement of holes relative to one another ("hole packing pattern"—e.g. 45 degree staggered, 60 degree staggered, or straight hole patterns, as discussed in more detail below), or a combination thereof. Applying a voltage to a heater so created creates different heating zones with different amounts of heat generation per area within the same material. This may be of particular interest, for example, in mold tool heating in which an even heat up is desirable for molded parts having sections with different thicknesses.

In the exemplary embodiment illustrated in FIG. 8A, each of the pair of busbars 832 and 834 comprises a first continuous busbar 832 connected to a first end 852 of the first area 810 and a first end 854 of the second area 812 adjacent to the first end of the first area and a first end 856 of the third area 814 adjacent to the first end of the second area, and a second continuous busbar 834 connected to a second end 862 of the first area 810 and a second end 864 of the second area 812 adjacent to the second end of the first area, and a second end 866 of the third area 814 adjacent to the first end of the second area.

Other exemplary hole patterns are illustrated in FIGS. 8B and 8C. FIG. 8B, illustrates a 60° Staggered Pattern 850, in which, for example, line 870*dgh* that runs through the centers of holes 860*d*, 860*g*, and 860*h* is disposed at a 60° angle relative to line 870*bcd* that runs through the centers of holes 860*b*, 860*c*, and 860*d*, and likewise line 870*bcd* is disposed at a 60° angle relative to line 870*bfh* that runs through the centers 860*b*, 860*f*, and 860*h*. It should be understood that although a total of eight holes are illustrated in FIG. 8B, this pattern may characterize any number of holes greater than or less than eight. The open area percentage for a 60° Staggered Pattern is calculated in accordance with Equation 2:

$$60^\circ \text{ Staggered Pattern \% Open Area} = 90.66(D/X)^2 \quad (2)$$

FIG. 8C illustrates a Straight Pattern 890 in which, for example, for example, line 270*uvw* that runs through the centers of holes 860*u*, 860*v*, and 860*w* is disposed at a 90° angle relative to line 870*ux* that runs through the centers of holes 860*u* and 860*x*. It should be understood that although a total of six holes are illustrated in FIG. 8C, this pattern may characterize any number of holes greater than or less than six. The open area percentage for a Straight Pattern can be calculated in accordance with Equation 3:

$$\text{Straight Pattern \% Open Area} = 78.5(D/X)^2 \quad (3)$$

It should be understood that although a total of three patterns 750, 850 and 890 have been illustrated here in FIGS. 7B, 8B, and 8C respectively, any number of patterns may be devised, each with its own equation for calculating open area percentage. Similarly, although the graph of FIG. 9 is provided as an example to illustrate a plot of percent open area for the specific pattern illustrated in FIG. 7B and characterized by Equation 1, each distinct hole pattern has a corresponding equation for calculating open area based upon the values of D and X that can be illustrated with a similar graph.

The process described herein may be employed to create laminar heating elements having a non-rectangular shape with an approximately uniform heat-up rate along the entire area of the non-rectangular shape. Previously, laminar heating elements typically have only been provided in rectangular shapes so that busbars 732, 734 in the heater are disposed constant width apart to maintain an constant current density in the direction of the current flow, such as in the arrangement illustrated in FIG. 7A which has a regular shape. The process described herein permits customizing or tuning the resistance in heaters, which may be particularly useful for heaters having non-rectangular or otherwise non-uniform shapes by applying varying hole patterns in different sections of a heater.

Figure 11B:
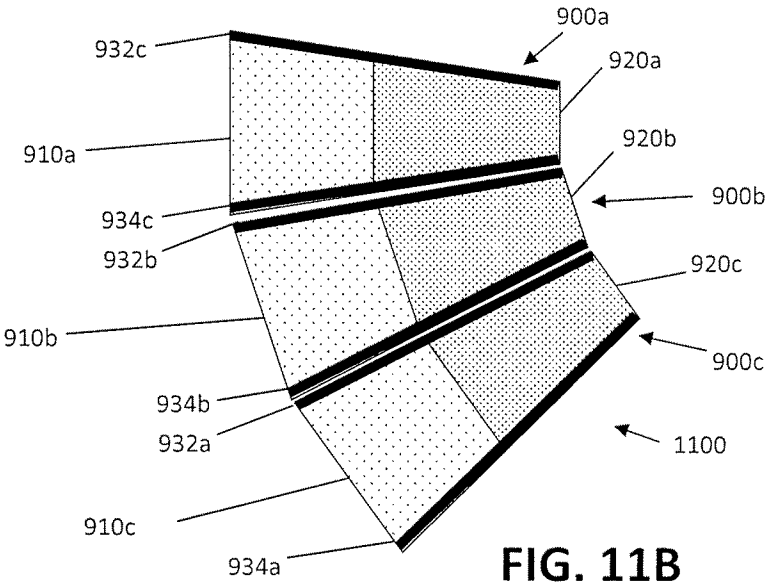
FIG. 11B illustrates an exemplary heater system comprising a plurality of the segmented heaters of FIG. 11A.
Figure 11A:
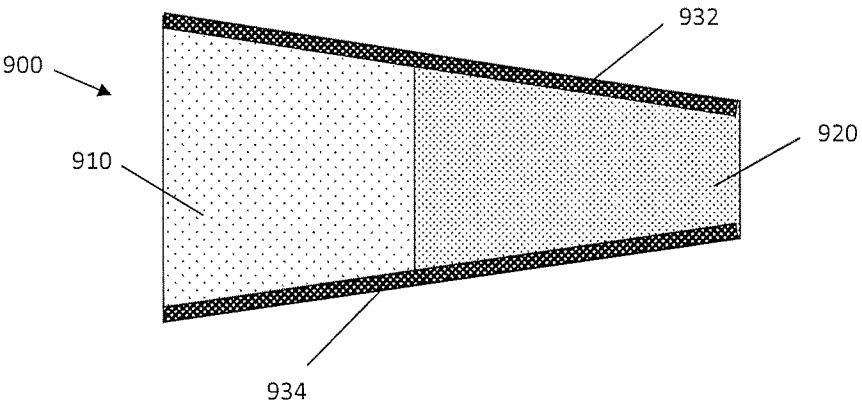
FIG. 11A illustrates an exemplary heater having an irregular shape with non-parallel busbars, in which different portions of the heater have different perforation patterns.

Thus, referring now to FIG. 11A, the process described herein and resulting structures may comprise a first area (e.g. area 910) having a first heat output per unit area and a second area (e.g. area 912) having a second heat output per unit area, wherein the busbars 932 and 934 have a first average distance from one another in the area 910 and a second average distance from one another in area 912. As depicted in FIG. 11A, heater element 900 may be characterized as having a "wedge shape" in which busbars 932 and 934 have a non-parallel, converging relationship from left to right. This aspect of the invention is not limited to any particular shape. Thus, it may be particularly desirable to implement different perforation patterns in adjacent areas of a continuous sheet so that the overall heat output of a first area (e.g. area 910) is, on average, essentially the same as (within a predetermined amount of tolerance), the second overall heat output of second area 912. Thus, while there may be some variation in the current density going from left to right along heater 900, the size of the adjacent, differently-patterned areas, and any gradients between them, can be tailored so that the variation in current density is acceptable, within a predetermined level of tolerance.

Thus, another aspect of the invention comprises a heating system 1100, as illustrated in FIG. 11B, comprising a plurality of laminar heaters 900*a*, 900*b*, 900*c*, each having a plurality of portions or areas 910 and 920, each portion or area having a different resistance, all connected to a common electrical controller (not shown) to provide heating over a surface. The terms "portions" or "areas" may be used interchangeably herein. For example, a plurality of the wedge shaped heaters 900*a*, 900*b*, 900*c* shown in FIG. 11A may be aligned as shown in FIG. 11B so that the upper busbar (e.g. 924*b*) of a first heater (900*b*) is parallel to the lower busbar (e.g. 924*a*) of an adjacent heater (900*a*). One of skill in the art will understand that while only three such heaters are depicted for illustration, arrangement of a sufficient number of heaters of similar shape enables construction of a nearly circular arrangement of heaters, such as would be suitable for lining a concave or convex, non-planar surface, such as, for example, a satellite dish.

Thus, in summary, the process disclosed herein comprises modifying the resistance of a laminar heating element without changing its underlying material properties, by perforating the laminar heating element with a hole pattern, which process may be employed to give different electrical resistance values in different areas of the sheet by using different hole patterns in the different areas. This allows a generic heater material to be used with a variable resistance capability, and allows a laminar heater to be designed with a variable resistance across the continuous surface of the heater, thereby providing different heating zones within the heater material itself. Although the technology permits providing a continuous laminar heating element with different hole patterns in different areas, it should be understood that in constructions comprising different discrete sheets of the same material with different hole patterns can also be placed adjacent to one another, and optionally connected to one another, such as with stitching, adhesive tape, or the like, without limitation. Applying varying hole patterns also permits creation of laminar heating elements with non-rectangular or non-uniform shapes.

Although described herein with respect to a specific exemplary laminar heating element, the process is not limited to any particular materials of construction. The process may be employed to tune or otherwise customize resistance of any laminar heating element or portion thereof having any materials of construction that are safely functional after perforation, and characterized by a resistance that varies with the open area percentage introduced by such perforations.

Although certain hole "packing" patterns are described and/or depicted herein (e.g. 45° Staggered 750 as illustrated in FIG. 7B, 60° Staggered 850 as illustrated in FIG. 8B, Straight 890 as illustrated in FIG. 8C), it should be understood that the invention is not limited to any particular hole packing patterns. Furthermore, the equations and charts provided herein, which are specific to particular patterns and particular materials of construction, and are provided herein merely as examples. Various materials of construction and patterns may be suitably characterized to develop the corresponding equations, functions and/or look-up tables needed to carry out the invention, manually or with the assistance of a computer, as will be understood to those of skill in the art.

Finally, although the non-rectangular heater shape depicted in FIG. 11A comprises two areas 910 and 920 with different hole patterns, in which each area has a trapezoidal shape, it should be understood that non-rectangular laminar heaters in which the busbars are spaced apart from one another in a non-parallel relationship, may have any shape, including busbars that define a curved shape rather than a straight line. It should also be understood that although the non-rectangular shape illustrated herein depicts two discrete areas having a clear separation between the areas, in which each area has a different average distance between the busbars, the change in open area may define a continuum or gradient in open area percentage that does not exhibit clear divisions between a first area with a first open area percentage and a second area with a second open area percentage. Areas 910 and 920 may be disposed on a continuous sheet of material, or may be discretely different sheets.

It should also be understood that some areas of the heater may have no perforations, and thus may have a zero open area percentage in that area, such as section 710 shown in FIG. 7A. Thus, exemplary heaters may comprise one or more areas having a zero open area percentage (e.g. area 710 shown in FIG. 7A) disposed adjacent an area having a non-zero open area percentage (e.g. area 720 shown in FIG. 7A), or areas adjacent one another with different open areas may both have non-zero open area percentages (e.g. areas 810 and 812, and areas 812 and 814 in FIG. 8A).

Furthermore, the heater may comprise a first discrete area (e.g. area 810 in FIG. 8A) having a first pattern throughout the first area and a second discrete area (e.g. area 814 in FIG. 8A) having a second pattern throughout the second area that is different than the pattern in the first area, in which the first and second areas are separated by a gradient area (e.g. area 812 in FIG. 8A) comprising a gradual change from the first pattern to the second pattern within the gradient area. In other embodiments, each adjacent area (e.g. 810, 812, 814)

may lie adjacent one another on a continuous sheet with no gradient section or other separation therebetween.

Finally, it should also be understood that a single sheet may have one, two, or to more than two patterns of holes or absence of holes in different portions of the sheet, to tailor the overall resistance in any manner desired. Furthermore, a system comprising multiple sheets may comprise a plurality of identical sheets (e.g. 900*a*, 900*b*, and 900*c* in FIG. 11B may be identical) or any number of different sheet types in which at least one sheet (e.g. sheet 900*c* in FIG. 11B) has a different property than at least one adjacent sheet (e.g. sheet 900*a*, sheet 900*c*, or both).

Although depicted with regular packing patterns, the invention is not limited to regular patterns. Although illustrated herein using round holes, it should be understood that holes of any shape may be employed, without limitation, particularly any shapes can be cleanly formed using any technology for forming holes known in the art. An exemplary embodiment using non-round perforations is depicted in FIG. 13 and explained in more detail herein below.

Figure 13:
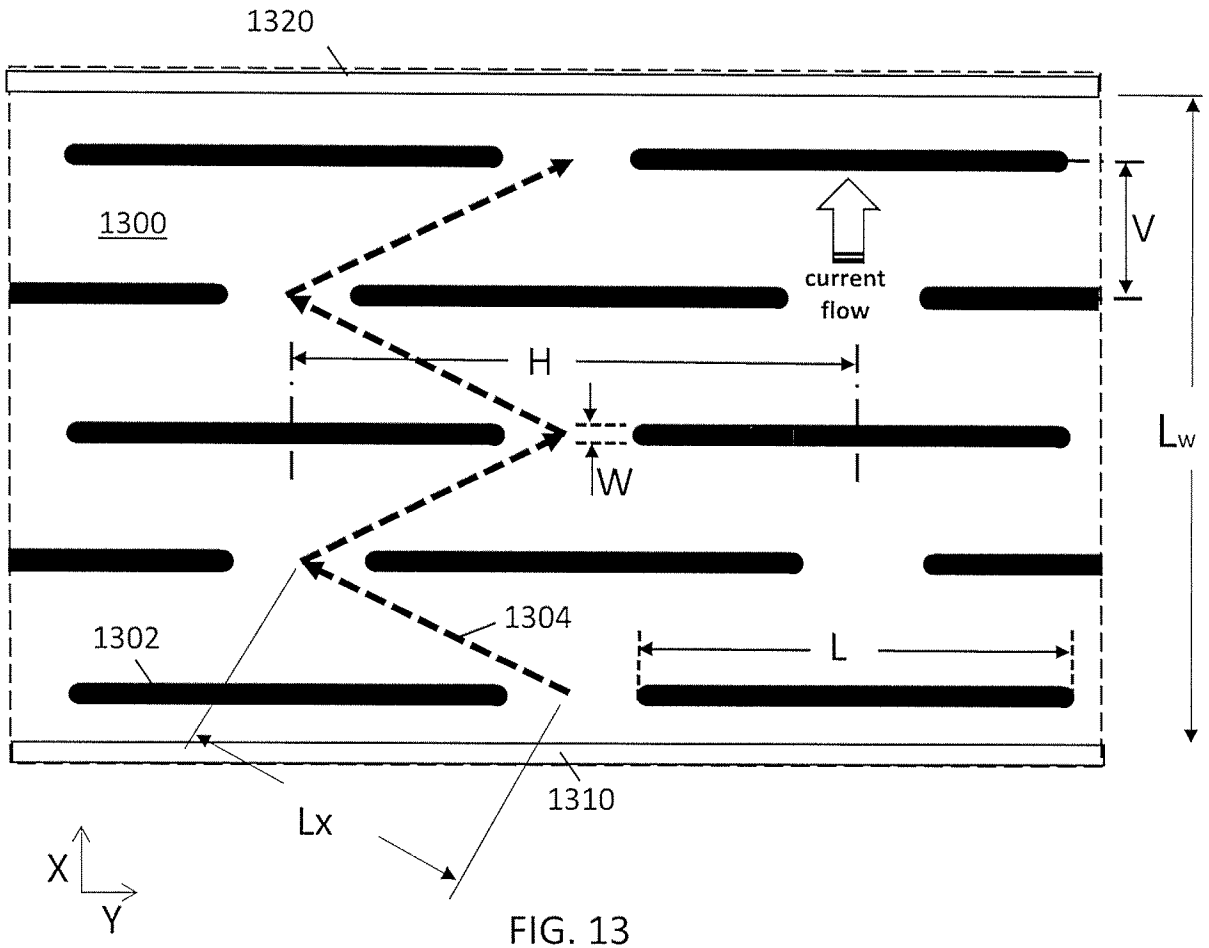
FIG. 13 illustrates an exemplary slit perforation pattern.

FIG. 13 depicts an exemplary sheet 1300 having a 45-degree staggered perforation pattern, in which each perforation 1302 is non-round in the shape of a slit. Each slit in the exemplary embodiment depicted has a length of L and a width of W, and adjacent slits in the same row are spaced a distance H on center, and adjacent rows are spaced a distance V on center. The formula for calculating the open area for such a configuration can be expressed as Equation 4:

$$\frac{(W \times L - 0.215W^2) \times 100}{0.5 \times V \times H} \tag{4}$$

A slit perforation design not only permits tailoring of the open space, but also permits tailoring of the developed path length 1304 that the electrons have to travel between the bus bars. This tailoring of path length enables tailoring of the electrical resistance of one portion of a heater relative to another while maintaining the same or similar open area in both portions. Maintaining the same or similar open area promotes uniformity in heating. A slot or slit pattern alters the flow path of the electrons more drastically/efficiently than a pattern of round perforations. The formula for calculating the path length Lx for a 45 degree offset slit configuration can be expressed as Equation 5:

$$Lx = \frac{0.5VH * sqrt(V^2 + L^2/4)}{1 - (WL - 0.215W^2)} \tag{5}$$

wherein sqrt($V^2$+$L^2$/4) is the contribution to the path length from the geometric vector, and the remaining portion of the equation is the contribution to the path length from the open area. It should be understood that the overall path length from busbar 1310 to busbar 1320 approximately equals (Lx)(#of rows of slits), plus the distance from each busbar to the nearest row, which dimension has a negligible impact over a long sheet. Thus, for a heating element having a length Lw between busbars with N rows of slit-shaped perforations, the resistance is proportional to N*Lx. The increase in resistance over the length Lw created by adding perforations relative to an otherwise identical unperforated heating element is generally proportional to N*Lx/Lw.

The term "slit" as used herein refers to a perforation that has a length dimension L that is longer than the width dimension W, in which the ratio L:W is at least greater than 2 and preferably greater than 10 and more preferably in a range of 10 to 200. The L direction is preferably disposed generally perpendicular to the flow path of the electricity through the heater element (e.g. the path between the positive and negative busbars), so that the electrons must go around the length dimension of the slit to continue travel in the flow path, such as in the path 1304 depicted in FIG. 13. The slits may be created by any method known in the art, including laser cutting, routing, etching, or the like. Slit sizes and spacing may be varied to create variable resistance in accordance with all of the various embodiments described herein.

It should be understood that use of non-round perforations, and specifically slit-type perforations, more specifically a 45-degree staggered slit perforation pattern as disclosed herein, are not limited to the embodiments having variable resistance across a given area or having non-parallel busbars, as described herein. For example, non-round perforations, specifically slit-type perforations, and more specifically a 45-degree staggered slit perforation pattern, or any of the perforation patterns described herein, may be implemented in any laminar heater or heater element having the features described in U.S. application Ser. No. 15/542,884 (the national phase application of the '633 WO Publication), owned by the Applicant of this Application, and incorporated herein by reference in its entirety. Laminar heaters and heater elements having non-round perforations, specifically slit-type perforations, and more specifically a 45-degree staggered slit perforation patterns, or any of the perforation patterns described herein, may also be used in products and busbar assemblies described in PCT Application Ser. No. PCT/IB2017/000870 (published as WO2017/216631) and U.S. Provisional Application Ser. No. 62/579,472, both of which are owned by the Applicant of this Application and which are hereby incorporated by reference in their entireties.

It should further be understood that just as open area percentage may be tailored to create a customized resistance, as described above, any perforation characteristic (e.g. geometry, spacing, perforation pattern, number of perforations per unit area, perforation size, open area percentage, path length, presence of absence of perforations at all, etc.) or any combination of perforation characteristics may be selected to give customized resistance in one area of a heating element relative to another. In particular, a combination of path length and open area percentage may together be tailored to provide an area of the heating element having desired heating characteristics. The perforation characteristics may be tailored to vary the electrical resistance in the material in both X and Y directions.

Although some exemplary hole sizes and spacing have been described herein, it should be understood that the sizes and spacing of the holes for a particular material may be limited to a range that collectively provides less than a threshold amount of current density in the non-open areas and less than a threshold amount of current density variation between areas directly bordering holes and areas not bordering the holes, which may also be dependent upon the smallest distances remaining between open areas (distance t as illustrated in FIG. 7B). Different materials may thus be characterized using methods known in the art for ensuring operation for a specific application within predetermined specifications.

The hole patterns thus created as described herein may be specified by a computer processor programmed with instructions for specifying the hole diameter, spacing, and packing pattern corresponding to the percentage open area needed to create a user-specified level of heat output for the subject heating material having a busbar configuration as specified by a user of such a computer. The various equations, look up tables, and the like may be programmed into the computer processor, and the computer processor may provide an output to a computer assisted manufacturing process to automatically create the perforations corresponding to the specifications generated by the computer. Thus, a user may be able to define a shape having specified dimensions for use with a specified heating element with well-characterized materials of construction and a pre-determined tolerance for variation in current density across the heating element, and the computer program may a automatically specify the hole pattern, diameters, and spacing across the entire dimension of the shape to achieve the desired heat output within the pre-determined tolerances. In particular, the computer processor may be well suited for creating subtle variations in hole diameter, spacing, and spacing angles within desired ranges to create a smooth gradient in overall current density and heat output between a first end of a sheet to another, such as from the leftmost side to the rightmost side of heating element 500. Thus, some exemplary embodiments may have no perceivable step change between one portion of the perforation pattern to another. The techniques for programming a computer to perform such a task are known in the art. In particular, techniques analogous to those utilized in the printing industry, in which dots of different sizes (AM screening), frequency (FM screening), or a combination thereof (hybrid AM/FM screening) are used over the course of a printed image to define areas that receive more or less ink, may be used for disposing perforations in a gradient in which the open area (analogous to ink deposition in printing) changes smoothly from one region to another to provide even resistance over the course of an irregularly shaped heating element in which opposite busbars are not parallel.

Segmented Heaters Having Segments with Different Open Areas

Although depicted herein with a first continuous busbar and a second continuous busbar separating a continuous sheet of a laminar heating element in FIGS. 7A and 7B and with uniform perforations in FIGS. 3A, 4A and 5, it should be understood that the foregoing methods and structures for providing variability in resistance and heat output using perforation patterns may be combined with the segmented design shown and described herein. In such an application combining both techniques, for example, different segments of a segmented heater or portions thereof, as described herein may have different open area percentages, with adjacent segments separated by a gap extending through one but not both of the busbars and through adjacent segments of the electrically conductive heating element such that multiple segments are disposed electrically in series.

Figure 4B:
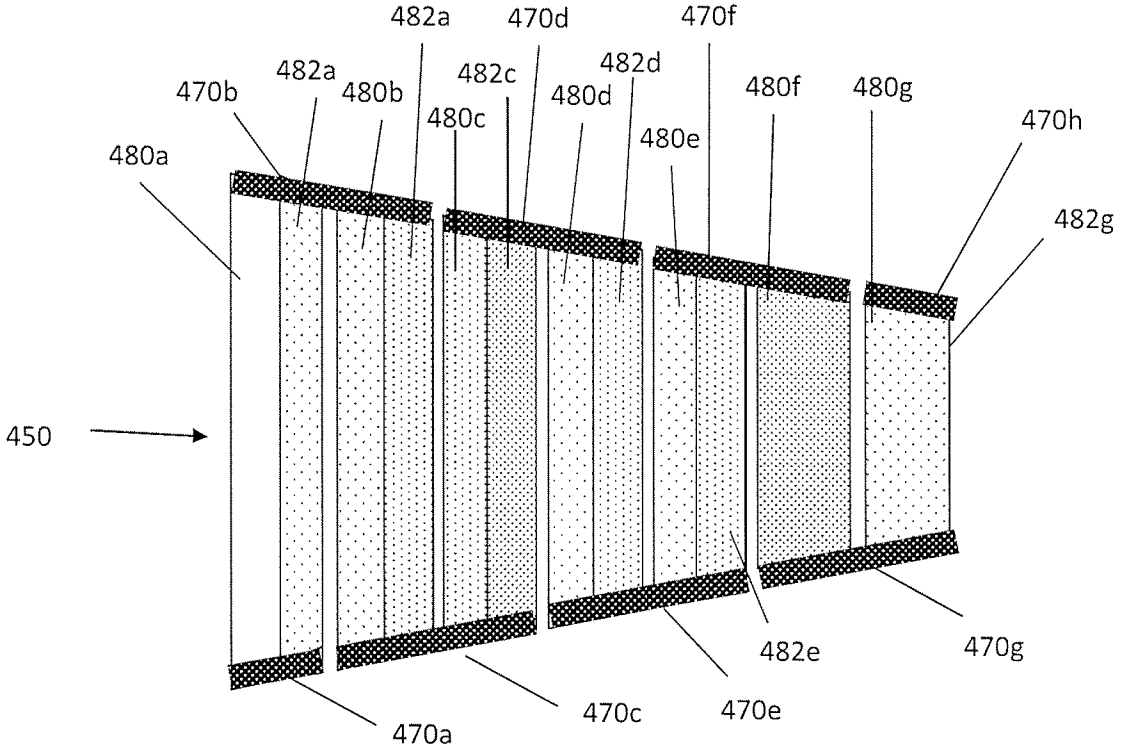
FIG. 4B illustrates an embodiment of a segmented heater having an irregular shape with non-parallel busbars, in which different portions of certain segments have different perforation patterns.

By way of example, referring now to FIG. 4B, segmented heater 450 may comprise a plurality of segments each comprising first and second portions 480*a-e* and 482*a-e*, in which adjacent portions on the same segment each have a different open area percentage, such as may be provided by having an absence of a perforation pattern in the first portion (e.g. 480*a*) and the presence of a perforation pattern in the second portion (e.g. 482*a*), or by having different perforation patterns in the first and second portions (e.g. 480*b*, 482*b*). Having different open area percentages in a single segment thus permits the heat generation in each segment between opposite busbars (e.g. between busbars 470*a* and 470*b* or between 470*b* and 470*c*) to be more evenly distributed than if the entire segment were of a single hole pattern. One or more of the segments may have the same combination of perforation patterns (e.g. segments 480*d*/482*d* and 480*e*/482*e*) or different combinations of perforation (or non-perforation) patterns may be present in different segments (e.g. as illustrated in segments 480*a*/482*a* and 480*b*/482*b* and 480*c*/482*c*), and one or more segments (e.g. 480*f* and 480*g*) may have only a single perforation pattern or lack thereof (not shown) throughout that segment, but each segment may have a different pattern relative to another. It should be understood that although each multi-portion segment is illustrated as having two discretely identifiable hole patterns, more than two such patterns may be provided on a single segment, and one of the perforation patterns may be a null pattern having no holes and no open area (e.g. as illustrated in section 480*a*). Furthermore, one or more of the segments may comprise a gradient perforation pattern (e.g. with increasing open area from left to right of the segment) with no readily identifiable step change between a first portion having a first open area percentage and a second portion having a second open area percentage.

Although illustrated in FIG. 4A with a wedge shape, it should be understood that the irregular (i.e. not rectangular) shape of one or more heaters may have any geometry, and that a combination of segmentation and customized perforation may be provided to establish generally uniform heating over a heater element having any shape or geometry. Customizing resistance in different portions of a heating element is not limited to use on irregular shapes, or shapes having non-parallel busbars, nor is it limited for the purpose of providing substantially uniform resistance. It some applications, it may be desirable to establish portions of a heating element that have one or more regions with a deliberately greater heat output than another portion.

Manufacturing Processes

Figure 6:
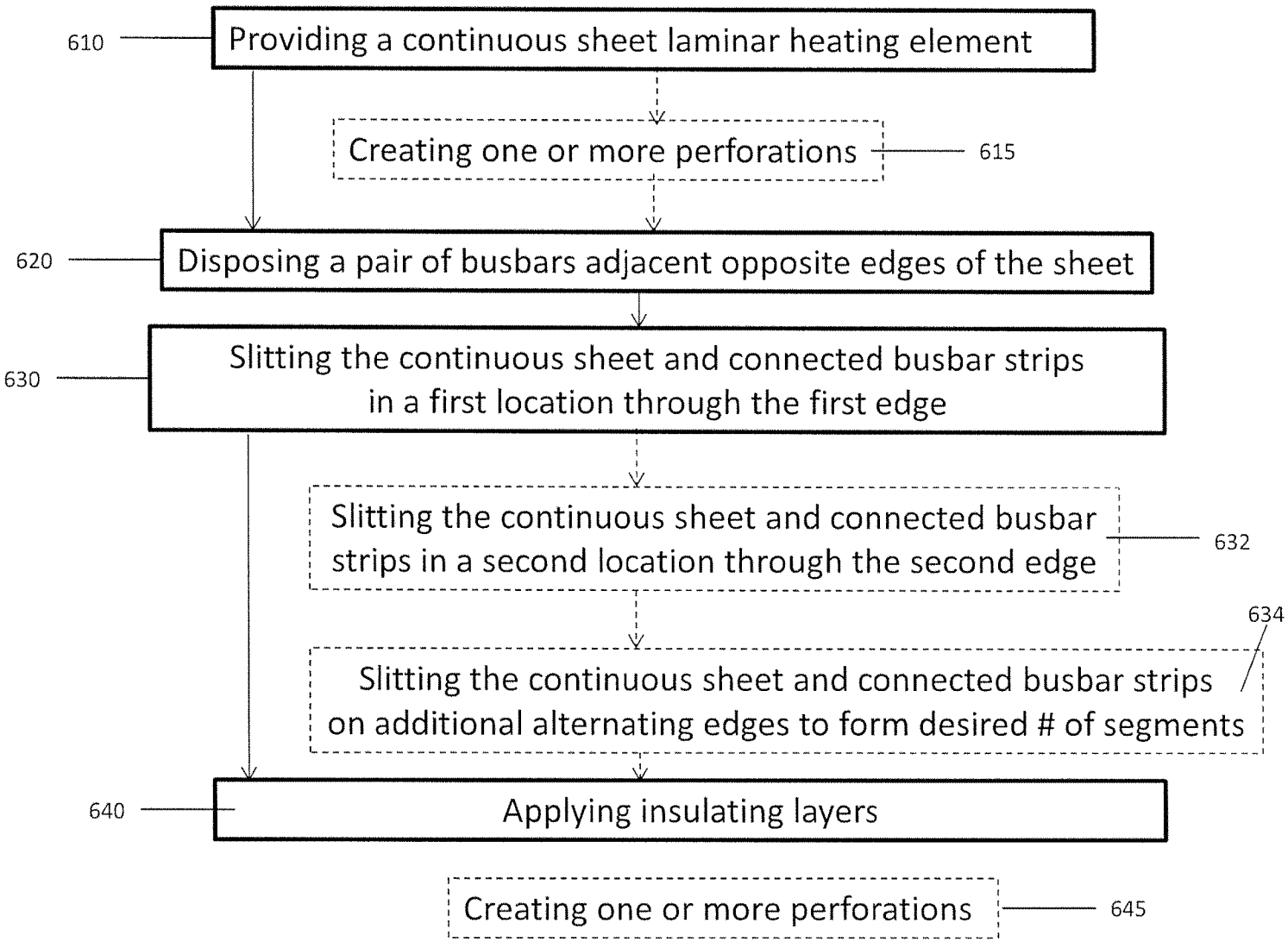
FIG. 6 illustrates an exemplary process for making a segment heater.

Although not limited to any particular method of manufacture, one exemplary process 600 for making a laminar heater as described herein is illustrated in the flowchart depicted in FIG. 6. Step 610 of the process comprises providing a continuous sheet of an electrically conductive laminar heating element material having a length and a width. In step 620, a pair of electrically conductive busbar strips are disposed on opposite sides of the continuous sheet, each busbar spanning the width of the sheet on each side. Step 630 comprises slitting the continuous sheet and connected busbar strips in a first location to define a first gap, first and second segments, and first and third busbars, wherein the slit extends through a first edge of the width of the sheet but not through the second, opposite edge. In step 640, a first insulating layer is applied over one surface of the heating element and a second insulating layer is disposed over an opposite surface of the heating element, which step preferably comprises substantially filling the first gap with insulating material. Optionally, to make a heating element segmented into more than two segments, the process further comprises, in step 632, slitting the continuous sheet in a second location to define a second gap, a third segment, and a fourth busbar, wherein the second slit location extends through the second edge but not through the first edge of the sheet. Thus, for a laminar heater comprising N segments, N+1 busbars, and N−1 gaps, in which the plurality of segments are electrically connected to one another in series from a first busbar on a first segment to an N+1th busbar on an Nth segment, the method may comprise as many slitting steps as are required between step 630 and 640, the steps comprising slitting the continuous sheet on alternating opposite sides thereof to define the N segments, N−1 gaps, and N+1 busbars.

If it is desired to have perforations in one or more of the segments, such as is shown in the exemplary heating element depicted in FIG. 4A, the process may optionally further comprise creating perforations in step 615 or in step 645, depending on whether it is desired to have the perforations extend through the insulating layer. The perforating step may comprise applying uniform perforations through the entire sheet, or applying different perforation patterns to different portions of the sheet. For manufacture of a non-segmented heating element, such as is depicted in FIGS. 7A, 8A, and 11A, steps 630, 632 and 634 are not performed.

The process of creating different open area percentages in different portions of a laminar heater to create different resistance in the different portions is not limited to utilizing different perforation patterns, as any process that creates open areas may be provided. Other techniques for modifying the resistance, such as with open area shapes that are not perforations may also be used. Furthermore, although the term "perforation pattern" is used herein, it should be understood that this term is not limited to any particular process, method or technique for making holes or open areas. For example, rather than making the holes in a fully formed sheet, alternative techniques may be utilized that form different portions with different open areas in other ways, such as for example, by conducting the initial wet laying step in such a manner that a desired distribution of voids, holes, or relatively greater and lesser areas of conductance are formed that constitute "open areas" at least with respect to the conductive materials of the sheet. Thus, it should be understood that the term "open area" refers to an area in the conductive portion of the sheet that has an absence of the conductive material, and that the open area may or may not be filled with some other substance, such as an insulator or a substance having a relatively lesser (or no) degree of conductance than the primary conductive material of the sheet.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A laminar heater comprising an electrically conductive laminar heating element comprising an electrically-conductive non-woven, non-metallic fiber layer comprising a wet-laid layer comprising a plurality of individual randomly-oriented, unentangled fibers in an absence of conductive particles, and a pair of electrically conductive busbars connected to opposite ends of the heating element, in which at least a first area has a first electrical resistance, and at least a second area has a second electrical resistance different from the first electrical resistance, wherein at least one of the first area or the second area has a plurality of perforations and the difference between the first electrical resistance and the second electrical resistance arises from a difference in a perforation characteristic of the first area relative to the second area.

2. The laminar heater of claim 1, further comprising a first insulating layer over one surface of the heating element and a second insulating layer over an opposite surface of the heating element.

3. The laminar heater of claim 1, wherein the first area comprises a first segment and the second area comprises a second segment, the first segment and the second segment electrically connected to one another in series and separated from one another by a first gap.

4. The laminar heater of claim 3, wherein at least one of the pairs of electrical busbars are disposed in a non-parallel relationship with one another.

5. The laminar heater of claim 1, further comprising a first insulating layer over one surface of the heating element and a second insulating layer over an opposite surface of the heating element, wherein the perforations extend through the heating element and the first and second insulating layers.

6. The laminar heater of claim 1, wherein the perforations are disposed in the heating element and insulating material is disposed within the perforations.

7. The laminar heater of claim 1, wherein the first area has no perforations and the second area has a perforation pattern defining a non-zero open area percentage.

8. The laminar heater of claim 1, wherein the first area has a first perforation pattern and the second area has a second perforation pattern.

9. The laminar heater of claim 1, wherein the first area has a different heat output per unit area than the second area.

10. The laminar heater of claim 1, wherein the first area has a first heat output per unit area and the second area has a second heat output per unit area, and the first heat output and the second heat output are on average, the same within a predetermined amount of tolerance, and the busbars have a first average distance from one another in the first area and a second average distance, different from the first average distance, from one another in the second area.

11. The laminar heater of claim 1, wherein the first area and the second area are connected to one another by a third area having third perforation pattern that defines a gradient between the first perforation pattern and the second perforation pattern.

12. The laminar heater of claim 1, wherein the first area and the second area lie adjacent one another on a continuous sheet of material.

13. The laminar heater of claim 12, wherein the pair of busbars comprises a first continuous busbar connected to a first end of the first area and a first end of the second area adjacent to the first end of the first area, and a second continuous busbar connected to a second end of the first area and a second end of the second area adjacent to the second end of the first area.

14. A heating system comprising at least one laminar heater of claim 1 connected to a controller and disposed on a surface for providing heat to the surface.

15. The heating system of claim 14, wherein the surface is a non-planar surface and the heating system comprises a plurality of laminar heaters, each having a wedge shaped geometry with a first edge non-parallel to a second edge, wherein each of the plurality of laminar heaters has at least a first busbar disposed along the first edge and at least a second busbar disposed along the second edge, and at least a first heater and a second heater adjacent to the first heater are disposed with the second busbar of the first heater parallel to the first busbar of the second heater.

16. The laminar heater of claim 1, wherein the first area comprises a first segment and the second area comprises a second segment, the first segment and the second segment electrically connected to one another in series and separated from one another by a first gap.

17. The laminar heater of claim 16, comprising the first segment and the second segment, wherein each segment has a first end and a second opposite end, a first busbar connected to a first end of the first segment, a second busbar connected to a second end of the first segment and a second end of the second segment, and a third busbar connected to a first end of the second segment, the second busbar comprising a continuous electrically conductive strip connected to both the first segment and the second segment, wherein the first and third busbars are separated from one another by the first gap.

18. The laminar heater of claim 1, wherein each of the first area and the second area has a uniformity of heat distribution in a range of ±5-7% temperature variation over that area.

19. The laminar heater of claim 1, wherein the heating element has a non-rectangular or non-uniform shape and has a uniform heat-up rate over an entirety of the non-rectangular or non-uniform shape.

20. The laminar heater of claim 1, wherein the plurality of perforations are non-round perforations.

21. The laminar heater of claim 1, wherein the plurality of perforations are disposed in a 45-degree staggered pattern.

22. The laminar heater of claim 1, wherein the plurality of perforations are non-round perforations disposed in a 45-degree staggered pattern.

23. The laminar heater of claim 22, wherein the plurality of non-round perforations comprise slits.

24. A process for manufacture of the laminar heater of claim 1, comprising the steps of:

(a) providing a continuous sheet of the electrically conductive laminar heating element material having a width and a length from a first edge to a second edge;

(b) disposing a pair of electrically conductive busbars adjacent opposite edges of the continuous sheet, each busbar extending the width of the sheet;

(c) defining at least two identifiable portions from or within the continuous sheet, in which at least one identifiable portion comprises the first area and the second area; and (d) applying a first insulating layer over one surface of the heating element and a second insulating layer over an opposite surface of the heating element; and (e) applying the plurality of perforations to the at least one portion of the heating element.

25. The process of claim 24, further comprising applying at least one perforation pattern to the first area and a second perforation pattern that is different than the first perforation pattern to the second area.

26. A process for making the laminar heater of claim 1, comprising the steps of:

customizing the electrical resistance of the first area and the second area by applying a first perforation characteristic in the first area and a second perforation characteristic in the second area, wherein the customizing is performed to give the laminar heater a uniform heat distribution and heat-up rate over an entirety of the first area and the second area.

27. The process of claim 26, wherein the customizing comprises selecting a first perforation characteristic that is different from the second perforation characteristic with respect to open area percentage, path length, or a combination thereof.

28. The process of claim 26, comprising customizing the laminar heater using a computer processor to specify the first customized perforation characteristic in the first area and the second customized perforation characteristic in the second area for the laminar heating element, based upon specified parameters for the heating element including at least heating element shape, heating element dimensions, busbar configuration, heating element materials of construction, desired level of heat output, and a pre-determined tolerance for variation in current density across the heating element, wherein the perforation characteristics include perforation pattern, perforation dimensions, and perforation spacing across the entire dimensions of the shape to achieve the desired level of heat output within the pre-determined tolerance.

29. The process of claim 28, further comprising automatically creating, using a computer assisted manufacturing process, the perforations in the heating element corresponding to the specified perforation characteristics generated by the computer processor.

30. A computer processor programmed with instructions for performing the process of claim 28.

31. The laminar heater of claim 1, wherein the plurality of perforations are non-round perforations having a length dimension L that is longer than a width dimension W, with a ratio L:W at least greater than 2.

32. The laminar heater of claim 31, wherein the ratio L:W is greater than 10.

33. The laminar heater of claim 31, wherein the length dimension is disposed perpendicular to a flow path through the laminar heating element between the pair of electrically conductive busbars, the plurality of perforations disposed in a staggered pattern array of rows having a space between adjacent rows, each of the first area and the second area having respective calculated electron flow paths, wherein the first area has a different calculated electron path length and different calculated resistance than the second area, but the first percent open area is the same as or sufficiently similar to the second percent open area such that heat distribution in both the first open area and the second open area are within a predetermined range of uniformity.

34. The laminar heater of claim 33, wherein the calculated electron path length in the first area is dependent upon a first set of values and the calculated electron path length in the second area is dependent upon a second set of corresponding values, wherein at least one of the values in the second set is different than at least one of the corresponding values in the second set.

35. The laminar heater of claim 33, wherein adjacent perforations in a same row are spaced a distance H on center, and adjacent rows are spaced a distance V on center, wherein the first set of values includes perforation length L1, perforation width W1, perforation row spacing distance V1, and adjacent same-row perforation spacing distance H1, and the second set of values includes perforation length L2, perforation width W2, perforation row spacing distance V2, and adjacent same-row perforation spacing distance H2, wherein at least one of the values L1, W1, V1, and H1 is different than the corresponding value L2, W2, V2, and H2.

* * * * *